US009027749B2

(12) United States Patent
Hill et al.

(10) Patent No.: US 9,027,749 B2
(45) Date of Patent: May 12, 2015

(54) WIPES DISPENSER WITH SELF-CLOSING LID

(71) Applicant: Kimberly-Clark Worldwide, Inc., Neenah, WI (US)

(72) Inventors: Robert M. Hill, Appleton, WI (US); Ryan L. Fulscher, Neenah, WI (US); Robert Schlaupitz, New London, WI (US); Kevin C. Possell, Middleton, WI (US); Kroy D. Johnson, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 9 days.

(21) Appl. No.: 13/863,135

(22) Filed: Apr. 15, 2013

(65) Prior Publication Data

US 2014/0305819 A1 Oct. 16, 2014

(51) Int. Cl.

| | |
|---|---|
| ***A47K 10/00*** | (2006.01) |
| ***B65D 43/16*** | (2006.01) |
| ***A47K 10/42*** | (2006.01) |

(52) U.S. Cl.

CPC ..... *A47K 10/00* (2013.01); *B65D 43/16* (2013.01); *A47K 10/42* (2013.01); *A47K 10/426* (2013.01)

(58) Field of Classification Search

CPC ..... A47K 2010/3266; A47K 10/426; A47K 10/421; A47K 10/42; A47K 10/32; B65D 83/0805; B65D 43/165; B65D 43/164; B65D 43/16; B65D 43/24

USPC ..... 220/844, 843, 836, 848, 810, 828, 827, 220/831, 832, 833, 834, 254.5, 254.6, 220/254.3, 254.2, 254.1, 259.2, 259.1, 220/256.1, 326, 324, 315; 206/233, 449, 206/494; 16/255, 279, 257, 278

See application file for complete search history.

(56) References Cited

U.S. PATENT DOCUMENTS

| | | | | | |
|---|---|---|---|---|---|
| 2,303,147 | A | * | 11/1942 | Tinnerman | 220/827 |
| 3,221,919 | A | * | 12/1965 | Gessner | 220/832 |
| 3,362,575 | A | | 1/1968 | Stephen | |
| 3,499,575 | A | | 3/1970 | Rockefeller | |
| 3,726,395 | A | | 4/1973 | Duhy | |
| 3,819,043 | A | | 6/1974 | Harrison | |
| 4,000,816 | A | | 1/1977 | Spruyt | |
| 4,143,762 | A | | 3/1979 | Spiegelberg | |
| 4,535,912 | A | * | 8/1985 | Bonk | 221/46 |

(Continued)

FOREIGN PATENT DOCUMENTS

| | | |
|---|---|---|
| DE | 75 36 172 U | 3/1976 |
| DE | 38 44 022 C1 | 2/1990 |

(Continued)

*Primary Examiner* — Robert J Hicks

(74) *Attorney, Agent, or Firm* — Kimberly-Clark Worldwide, Inc.

(57) ABSTRACT

A container for storing wipes that can be dispensed by a consumer includes a container body. The container body includes a bottom wall, a midsection, and a top wall. The container body can define an interior cavity for storing the wipes. The container can further include a dispensing aperture in the container body and a lid. The lid is configured to be opened and closed, providing access to the dispensing aperture when open and hindering access to the dispensing aperture when closed. The lid can be urged to the closed position when the lid is in a first range of positions between the open position and the closed position and can be urged to the open position when the lid is in a second range of positions between the open position and the closed position.

26 Claims, 16 Drawing Sheets

(56) References Cited

U.S. PATENT DOCUMENTS

| | | | |
|---|---|---|---|
| 4,553,668 | A | 11/1985 | James et al. |
| 4,694,973 | A | 9/1987 | Rose et al. |
| 5,483,999 | A | 1/1996 | Lampropoulos et al. |
| 6,065,591 | A | 5/2000 | Dill et al. |
| 6,318,590 | B1 | 11/2001 | McMurray-Stivers |
| D467,799 | S | 12/2002 | Persson |
| 6,520,331 | B2 | 2/2003 | Okin et al. |
| 6,561,378 | B1 | 5/2003 | Roessler et al. |
| 6,848,594 | B2 | 2/2005 | Holland |
| 6,908,007 | B2 | 6/2005 | Hrdlicka |
| D523,668 | S | 6/2006 | Azrak |
| 7,178,672 | B2 | 2/2007 | Arkins |
| D540,188 | S | 4/2007 | Karussi et al. |
| D541,173 | S | 4/2007 | Karussi et al. |
| 7,198,161 | B2 | 4/2007 | Bucholtz |
| 7,228,984 | B2 | 6/2007 | Tack et al. |
| D552,468 | S | 10/2007 | Seum et al. |
| 7,328,869 | B1 | 2/2008 | Zies |
| D571,226 | S | 6/2008 | Bartolucci et al. |
| D574,246 | S | 8/2008 | Russell et al. |
| D584,614 | S | 1/2009 | Russell et al. |
| 7,530,472 | B2 | 5/2009 | Bitowft et al. |
| 7,537,137 | B2 | 5/2009 | Giraud |
| 7,559,434 | B2 | 7/2009 | Masting |
| 7,597,213 | B2 | 10/2009 | McDonald |
| 7,762,426 | B2 | 7/2010 | Stevens et al. |
| 7,922,036 | B2 | 4/2011 | Bendor et al. |
| D649,659 | S | 11/2011 | Belfance et al. |
| 2006/0180596 | A1 | 8/2006 | Young et al. |
| 2007/0215632 | A1 | 9/2007 | Bendor et al. |
| 2008/0025787 | A1 | 1/2008 | Shea |
| 2008/0105699 | A1 | 5/2008 | Wong et al. |
| 2009/0152290 | A1 | 6/2009 | Wang et al. |
| 2010/0059539 | A1 | 3/2010 | Giraud et al. |

FOREIGN PATENT DOCUMENTS

| | | | |
|---|---|---|---|
| DE | 20 2011 003 375 | U1 | 8/2011 |
| GB | 2 457 461 | A1 | 8/2009 |
| JP | 2001-002102 | A | 1/2001 |
| JP | 2002-096835 | A | 4/2002 |
| JP | 2008-114895 | A | 5/2008 |
| JP | 2009-234598 | A | 10/2009 |
| WO | WO 2006/035697 | A1 | 4/2006 |
| WO | WO 2006/070771 | A1 | 7/2006 |
| WO | WO 2006/107021 | A1 | 10/2006 |

* cited by examiner

WIPES DISPENSER WITH SELF-CLOSING LID

BACKGROUND

There is a variety of storing and dispensing containers in the market, particularly those for storing and dispensing personal care products. Personal care products, specifically wipes, have been made from a variety of materials which can be dry or wet when used. Wet wipes can be moistened with a variety of suitable wiping solutions. Such wet wipes have been designed for end uses including, but not limited to, baby wipes, hand wipes, household cleaning wipes, industrial wipes, and the like.

Typically, the dispensing containers are rectangular shaped and are configured to store the wet wipes in a stacked configuration in a horizontal orientation or the dispensing containers are cylindrical in shape and configured to store the wipes in a rolled configuration in a vertical orientation. When the wet wipes are stored in a stacked configuration, the wipes can be in a folded configuration, such as a c-folded, z-folded or quarter-folded configuration, or other configurations as are well known to those skilled in the art. Sometimes the folded wet wipes have also been interfolded with the wet wipes immediately above and below in the stack of wet wipes. When the wipes are stored in a rolled configuration, the wipes have commonly been placed in containers in the form of a continuous web of material in a roll and is stored in the cylindrical dispenser in a vertical orientation. Such continuous webs often include perforations to separate the individual wet wipes.

In either configuration, these conventional wet wipes packages have generally provided a plastic container, tub, or package which provides a sealed environment for the wet wipes to ensure that they do not become dirty and/or to inhibit a reduction of moisture. Some containers have a lid that is opened by pressing a button on top of the container to disengage a latch and provide access to the wipes. In some containers, the lid is configured to remain open to allow the consumer access to dispense one or more wipes from the container. After completing the desired dispensing, a consumer is required to shut the lid on the container to protect the wipes from dirt and other debris in the environment, and in the context of wet wipes, to provide a seal to retain the moisture properties of the wipes. However, the latches and latching mechanisms that are common to conventional containers, present a potential to not be fully engaged, and thus, not provide the proper protection from the surrounding elements and not form the desired seal, including when the consumer may believe that such latching mechanism has engaged and formed a proper seal.

Additionally, the conventional containers which contain wipes have typically been designed to be positioned on a flat surface such as a countertop, table, flat workstation, toilet tank lid, or the like. In some situations, the consumer may desire to open the lid of the container, dispense the necessary amount of wipes, and close the lid of the container with one hand without removing the container from the flat surface. Some of the conventional containers do not allow such operation, and even in the containers which do allow it, such containers may become unstable during the opening of the lid, the dispensing of the wipes, or the closing of the lid. Furthermore, sometimes it is desired to keep the containers against a vertical surface when performing these operations, such as a wall, where they are out of the way for other activities that may occur on the flat surface or items that may also be stored on the flat surface. Such storage concerns may present difficulties in opening the lid, dispensing the wipes, or closing of the lid as desired.

In the dispensers storing the wipes in a stacked configuration and in a horizontal orientation, the wipes are often placed in a horizontal position with a parallel dispensing partition above the stack so that the wipes are dispensed in an upward fashion. While this design has proven dispensing performance, it requires a large space footprint when free-standing and limits wall mounting opportunities.

Therefore, there is a need to provide a container for dispensing wipes that may be placed in an upright position without affecting dispensing performance or the ability to open and properly close the lid. There is also need to provide a container for dispensing wipes that has enhanced handling, opening, dispensing, and closing abilities to ensure proper sealing and increased stability when the consumer is utilizing the container.

SUMMARY

A container for storing wipes that can be dispensed by a consumer is disclosed. The container includes a container body. The container body includes a bottom wall, a midsection, and a top wall. The container body can define an interior cavity for storing the wipes. The container can further include a dispensing aperture in the container body and a lid. The lid is configured to be opened and closed, providing access to the dispensing aperture when open and hindering access to the dispensing aperture when closed. The lid can be urged to the closed position when the lid is in a first range of positions between the open position and the closed position.

In another form, a container for storing wipes that can be dispensed by a consumer is disclosed. The container includes a container body. The container body includes a bottom wall, a midsection, and a top wall. The container body can define an interior cavity for storing the wipes. The container can further include a dispensing aperture in the container body and a lid. The lid is configured to be opened and closed, providing access to the dispensing aperture when open and hindering access to the dispensing aperture when closed. The container can further include an elastic element. The elastic element can urge the lid to the closed position.

In yet another form, a container for storing wipes that can be dispensed by a consumer is disclosed. The container includes a container body. The container body includes a bottom wall, a midsection, and a top wall. The container body can define an interior cavity for storing the wipes. The container can further include a dispensing aperture in the container body and a lid. The lid is configured to be opened and closed, providing access to the dispensing aperture when open and hindering access to the dispensing aperture when closed. The top wall can include a raised rib around a substantial portion of a perimeter of the top wall. The raised rib can sealingly engage an inner surface of the lid when the lid is in the closed position.

BRIEF DESCRIPTION OF THE DRAWINGS

A full and enabling disclosure thereof, directed to one of ordinary skill in the art, is set forth more particularly in the remainder of the specification, which makes reference to the appended figures in which.

DETAILED DESCRIPTION

Figure 1:
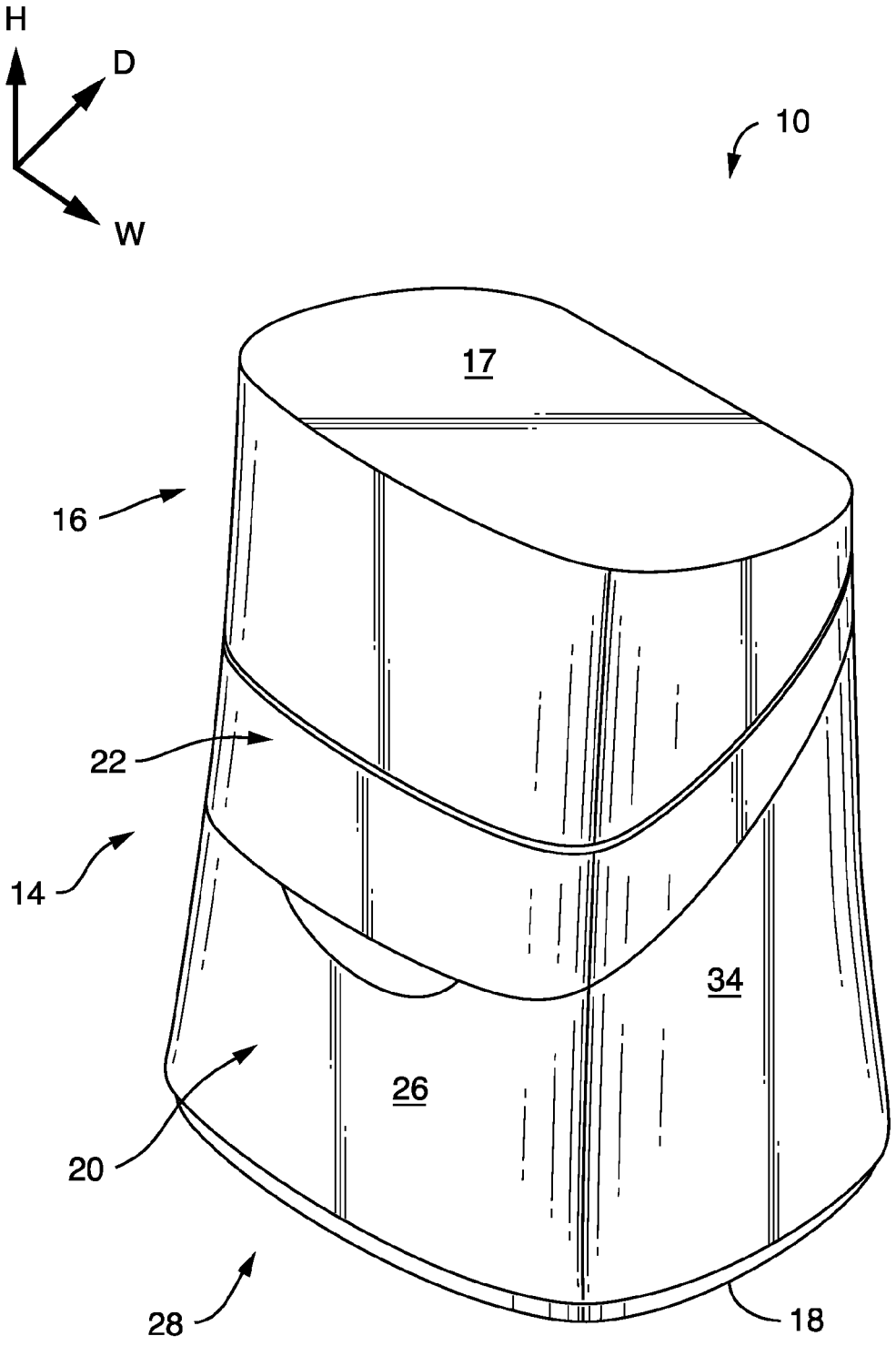
FIG. 1 illustrates a front perspective view of an exemplary wipes container.

Reference will now be made in detail to the presently preferred embodiments of the invention, one or more examples of which are illustrated in the drawings. Each example is provided by way of explanation and is not meant as a limitation. For example, features illustrated or described as part of one embodiment or figure can be used on another embodiment or figure to yield yet another embodiment. It is intended that the present disclosure include such modifications and variations.

Figure 2:
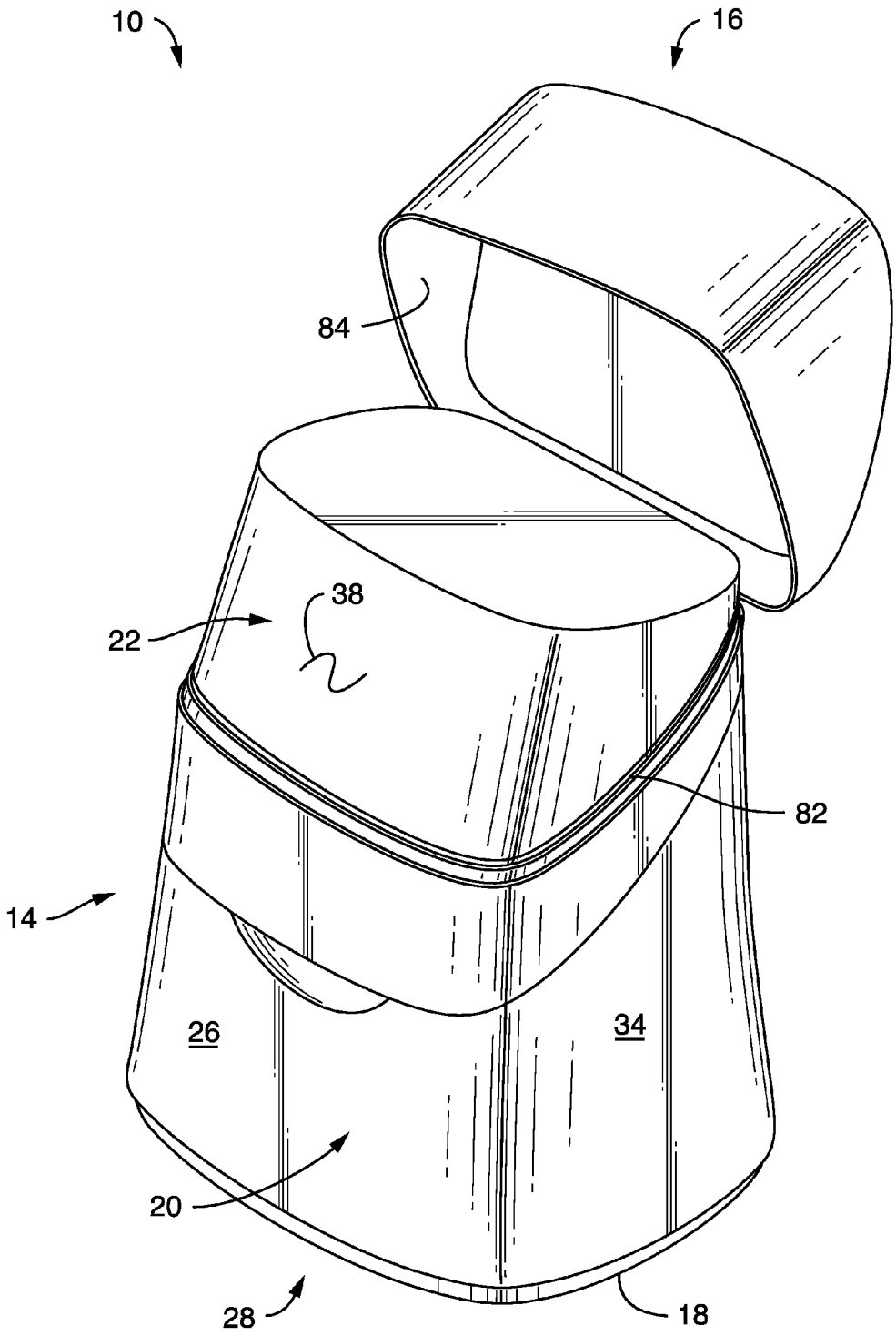
FIG. 2 illustrates a front perspective view of the wipes container of FIG. 1 with the lid opened.
Figure 3:
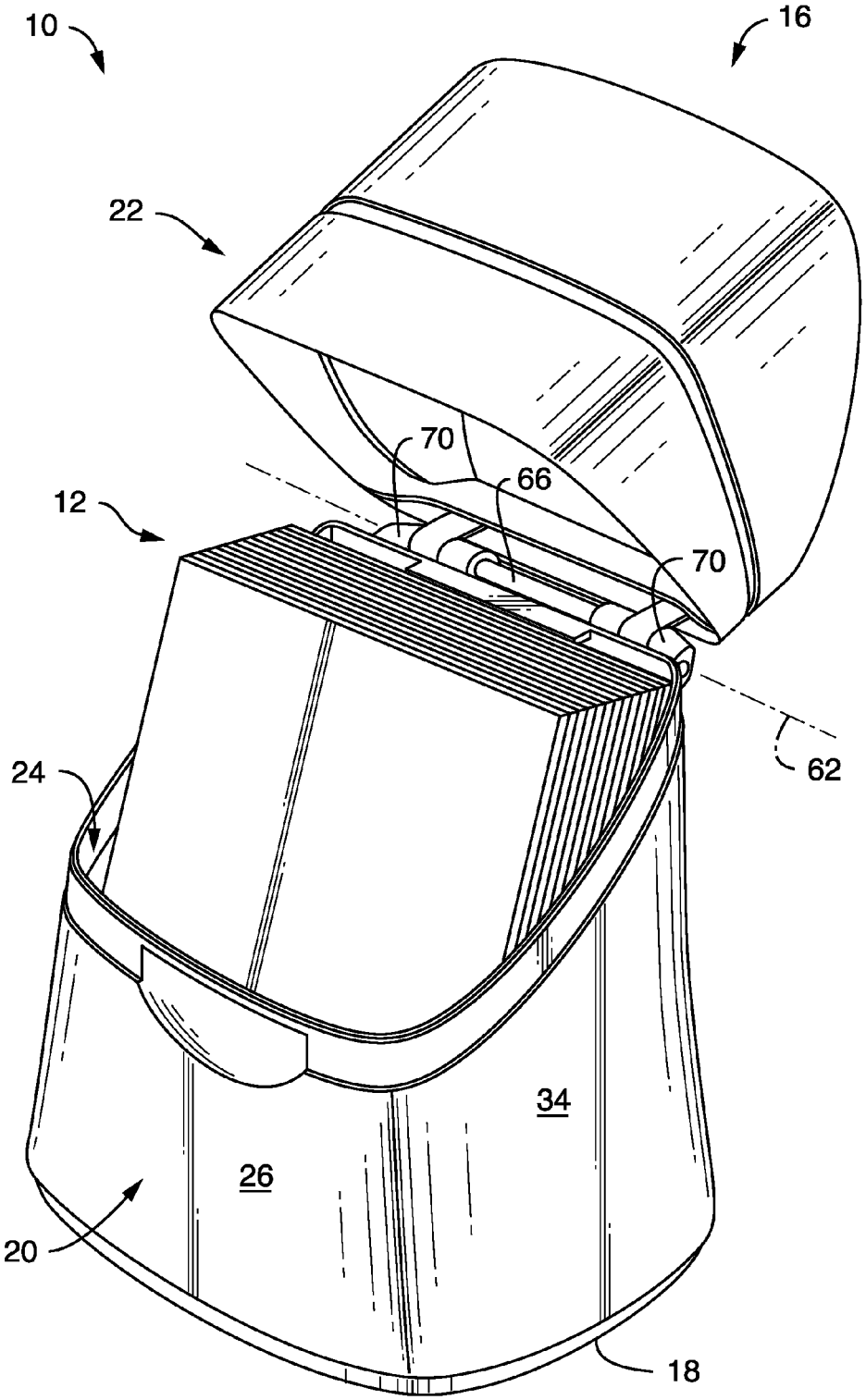
FIG. 3 illustrates a front perspective view of the wipes container of FIG. 1 with both the lid opened and the top wall of the container base opened showing a plurality of wipes in a stacked fashion in a vertical orientation.

FIGS. 1-12 illustrate a container 10 for storing personal care products, such as a plurality of wipes 12. The container 10 includes a container body 14 and a lid 16. The container body 14 can include a bottom wall 18, a midsection 20, and a top wall 22. The container body 14 can define an interior cavity 24 for storing the plurality of wipes 12. As shown in FIG. 3, the plurality of wipes 12 can be stored in the interior cavity 24 in a stacked fashion and in a vertical orientation. It is contemplated, however, that the container body 14 can alternatively be configured to store the plurality of wipes 12 in a rolled fashion and/or in a horizontal orientation, as is known in the art.

The container 10 can have a generally rectangular shaped profile as shown in the embodiment in FIGS. 1-12. In the exemplary embodiment of container 10, the midsection 20 of the container body 14 can include a front wall 26 located in a front portion 28 of the container 10, a rear wall 30 located in a rear portion 32 of the container 10, and two side walls 34, 36 located in between the front wall 26 and rear wall 30. The front wall 26 is opposite from the rear wall 30 and the side walls 34, 36 are opposite from one another. Of course, the container 10 may be configured in other profiles, including, but not limited to, generally cylindrical profiles. In such a circumstance, the midsection 20 can be considered to be a unitary segment, rather than having a specific front wall 26, rear wall 30, and side walls 34, 36.

As illustrated in FIG. 2, the container body 14 can include a dispensing aperture 38 in the top wall 22 of the container body 14. A portion of the top wall 22, particularly near the dispensing aperture 38, can be manufactured from a thin, rubber-like, anti-slip material. The bottom wall 18 or a portion thereof can also be manufactured from a thin, rubber-like, anti-slip material. Examples of flexible rubber-like materials used in the container of the present disclosure include thermoplastic elastomeric (TPE) materials that can be used to provide acceptable dispensing. Materials which can be employed include (but are not limited to): any of the family of styrenic-based TPE's (i.e. styrenic block copolymer compounds); styrenic-based TPE's containing rubber modifiers such as Kraton™, Santoprene™, or other rubber modifiers; specialty copolymers, such as ethylene-methyl acrylate copolymers (e.g. EMAC™ of the Eastman Chemical Company); thermoset rubbers; polyurethane; alloys; amides; engineering TPE's; olefinic-based; olefinic vulcanizates; polyester-based; polyurethane-based.

In the embodiment shown in FIGS. 1-12, the dispensing aperture 38 is shown as a sinusoidal-type aperture in the top wall 22 of the container body 14 and in the front portion 28 of the container 10 near the front wall 26, however, the dispensing aperture 38 is not intended to be limited to such a configuration or location on the container 10. The dispensing aperture 38 can assist a consumer in the dispensing of an individual wipe from the plurality of wipes 12 by providing friction to the leading wipe from the plurality of wipes 12 as it is pulled through the dispensing aperture 38. This friction can help the consumer withdraw only a single wipe from the plurality of wipes 12, as is known in the art, whether the plurality of wipes 12 are in a stacked or rolled configuration and/or perforated in the various configurations known by one of ordinary skill in the art.

Figure 9:
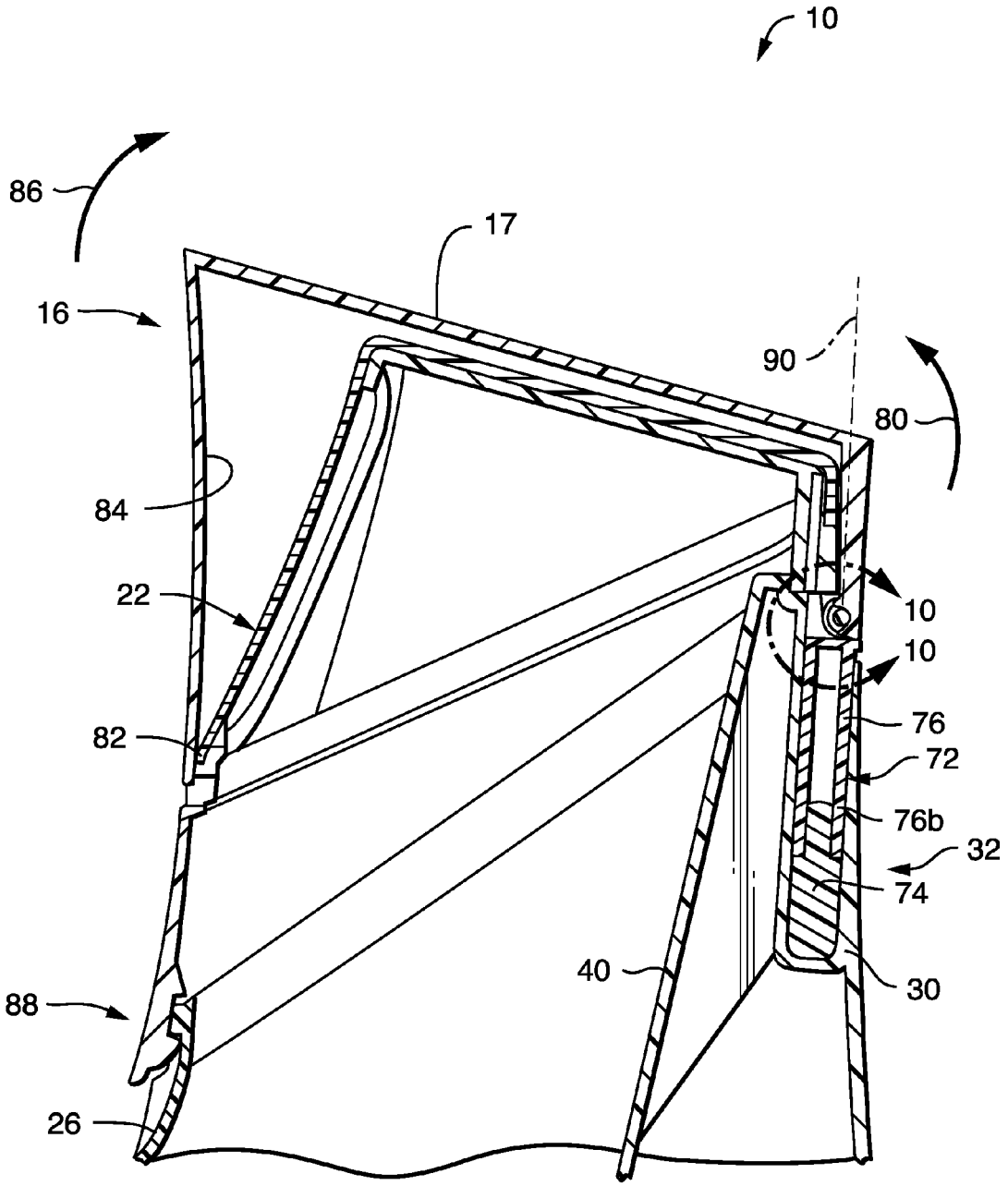
FIG. 9 illustrates a cross-sectional, detailed view taken along line 9-9 in FIG. 7 with the lid being in a closed position.
Figure 10:
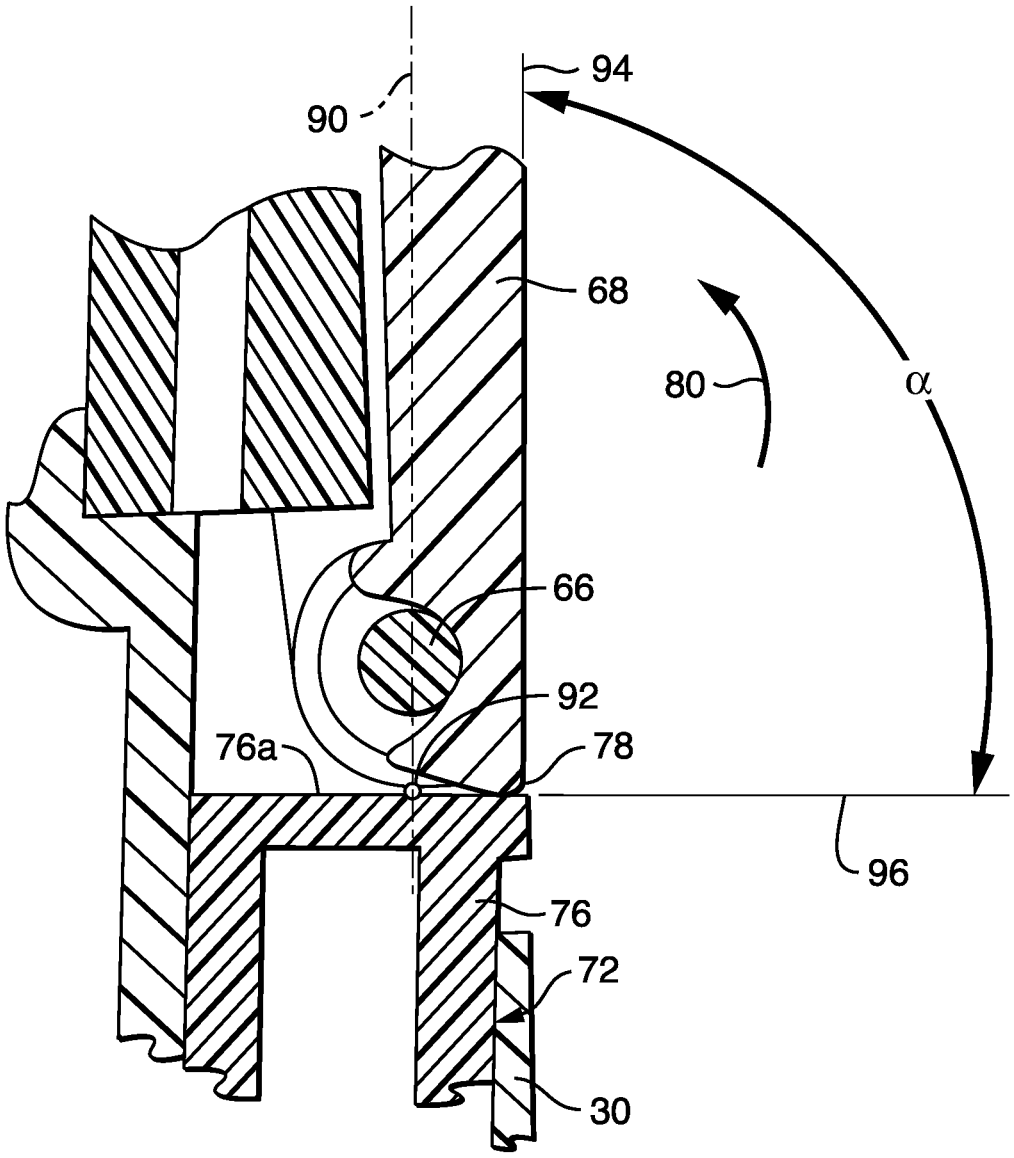
FIG. 10 illustrates a cross-sectional, detailed view taken along line 10-10 in FIG. 9.
Figure 11:
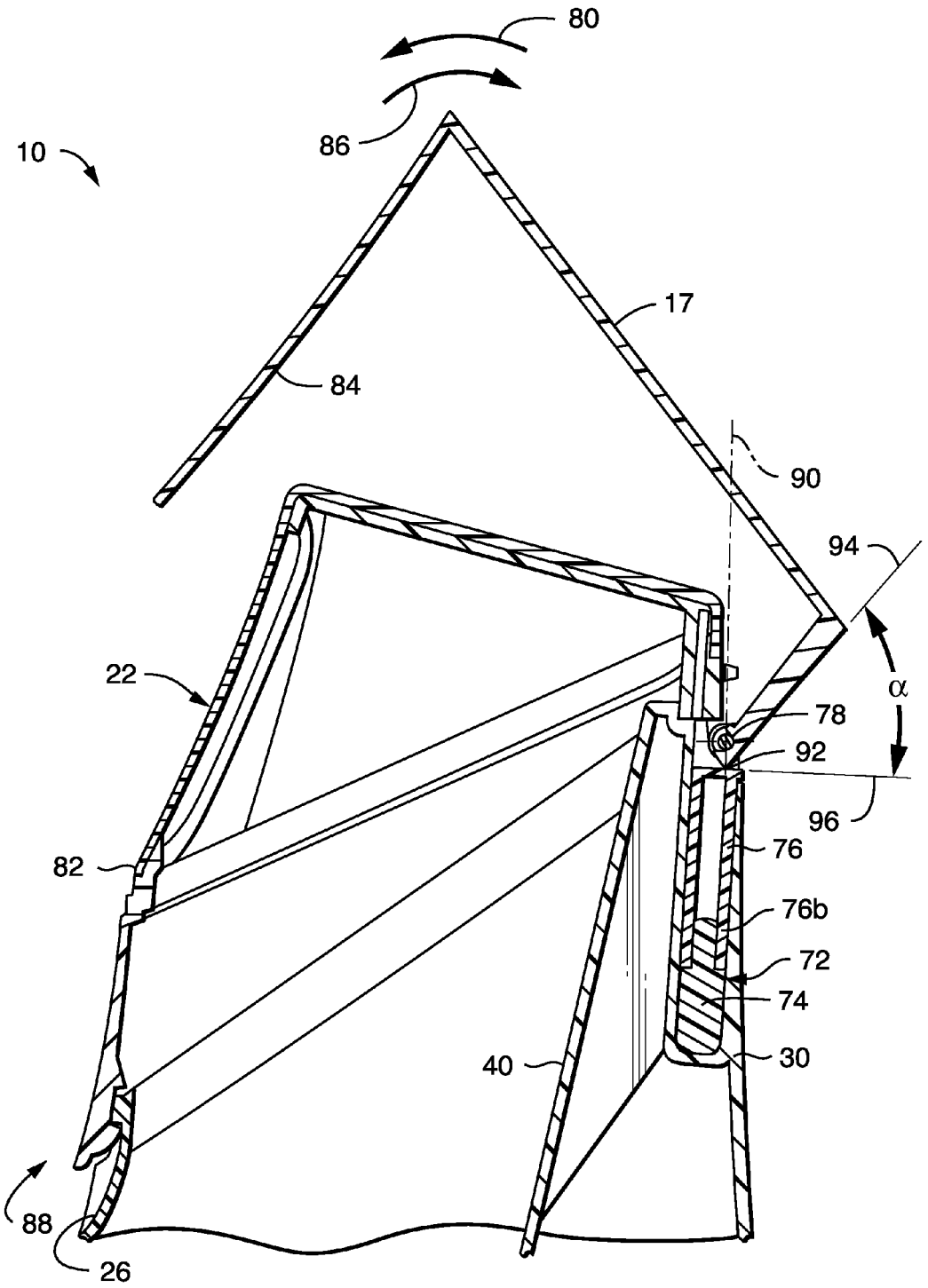
FIG. 11 illustrates a cross-sectional, detailed view similar to FIG. 9, but with the lid being in a partially open position.

As shown in FIG. 3, the wipes can be stored in the interior cavity 24 in a stacked configuration and in a vertical orientation. As used herein, a vertical orientation means that the plurality of wipes 12 are stacked so that the end edges of each individual wipe that form the plurality of wipes 12 are oriented toward the bottom wall 18 more so than the midsection 20 of the container body 14. The end edges referred to herein could be a cut edge or a folded edge of each wipe of the plurality of wipes 12, depending on the configuration in which the plurality of wipes 12 are stored. As illustrated in FIGS. 9-11, the container can include a support partition 40 that is designed for the plurality of wipes 12 to rest against.

In the exemplary embodiment, the plurality of wet wipes 12 stored in the container are wet wipes that can be used for baby wipes, flushable moist wipes, household cleaning wipes, industrial wipes, and other wiping applications and end uses. Materials suitable for the wipes 12 of the present disclosure are well known to those skilled in the art. For wet wipes, these can be made from any material suitable for use as a moist wipe, including meltblown, coform, air-laid, bonded-carded web materials, hydroentangled materials, high wet-strength tissue, and the like, and can comprise synthetic or natural fibers, or combinations thereof. The wipes can contain a liquid which can be any solution that can be absorbed into the wipes, thus making them "wet wipes." The liquid absorbed into the wipes can include any suitable components that provide the desired wiping properties. For example, the components can include water, emollients, surfactants, preservatives, chelating agents, pH buffers, fragrances, or combinations thereof. Additionally, the liquid can contain lotions, ointments and/or medicaments. The amount of liquid contained within each wet wipe can vary depending upon the type of material being used to provide the wet wipe, the type of liquid being used, the type of container being used to store the stack of wet wipes, and the desired end use or intended application of the wet wipe. By way of example, each wet wipe can contain from about 15 to about 600 weight percent and desirably from about 200 to about 400 weight percent liquid based on the dry weight of the wipe for improved wiping functionality.

Figure 8:
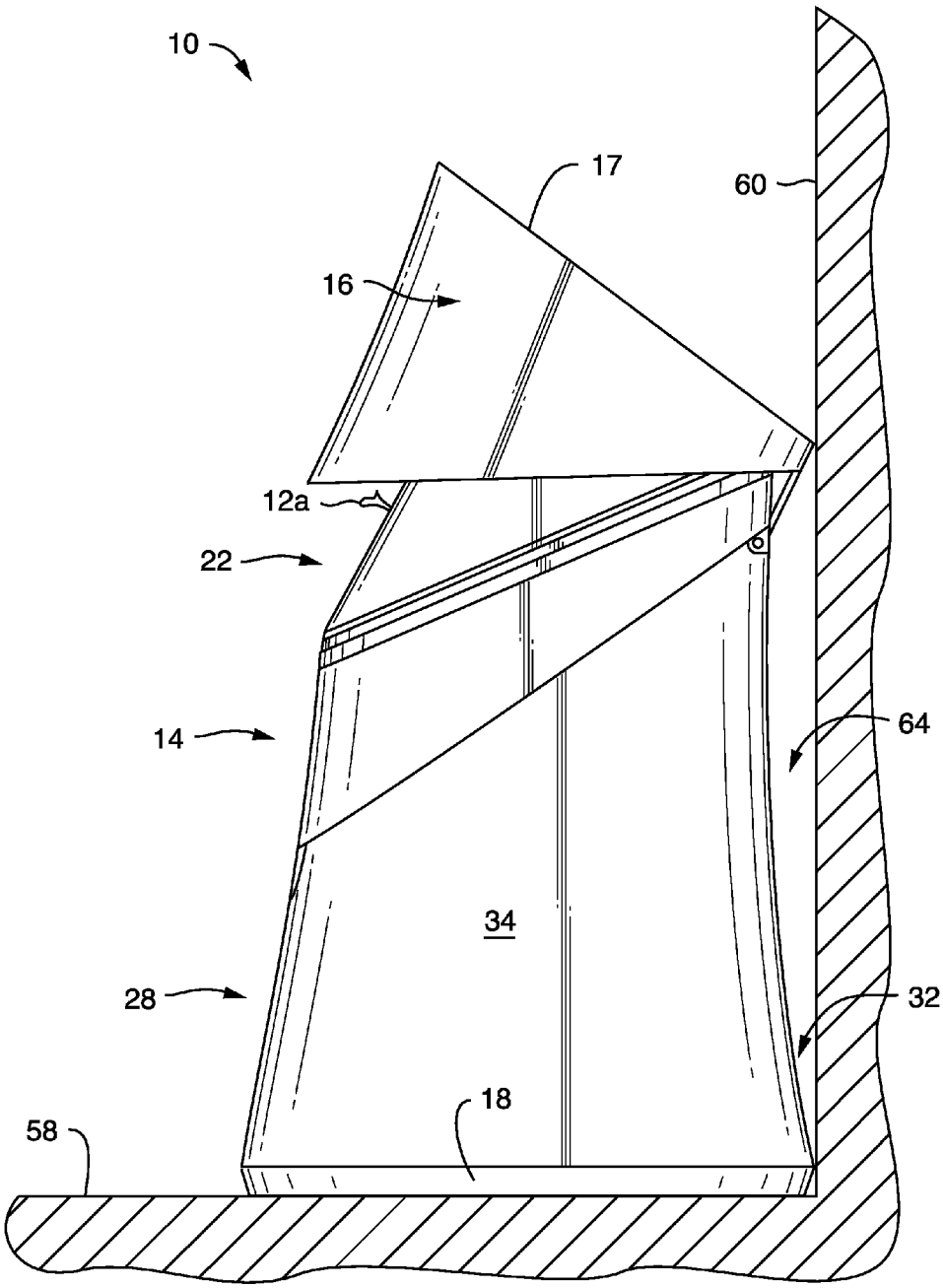
FIG. 8 illustrates a side elevational view of the wipes container of FIG. 1 with the wipes container being placed on a flat surface with the rear portion located against a vertical wall and the lid partially opened.

The lid 16 can include a top surface 17 that is angled toward the front portion 28 of the container 10. As shown in FIGS. 1-3, and as will be described in further detail below with respect to FIGS. 9-13, the lid 16 is configured to open and close by moving between an open position and a closed position. When the lid 16 is in an open position, as illustrated in FIG. 2, the lid 16 can provide access to the plurality of wipes 12. In FIG. 2, a consumer can access the wipes 12 via the dispensing aperture 38 in the top wall 22, which may hold the leading edge 12*a* (as shown in FIG. 8) of the next successive wipe in the stack of wipes 12. Additionally, if both the lid 16 and the top wall 22 of the container body 14 are in an open position, as illustrated in FIG. 3, a consumer also has access to the plurality of wipes 12 and can replenish the container 10 with a plurality of wipes 12 as desired.

Although the wipes 12 are shown as being arranged in the exemplary container 10 in a stacked configuration and in a substantially vertical orientation, the container 10 can be configured to store the wipes 12 in any manner which provides convenient and reliable one at a time dispensing and which assists the wipes in not becoming dirty and/or overly dry. For example, the wipes may be individual wipes which are folded in a c-fold, z-fold, quarter fold, or other zigzag fold, or interfolded or non-interfolded configurations as are known to those skilled in the art. The individual wipes can be interfolded or in other ways related such that the leading and trailing end edges of successive wipes in the stacked configuration overlap, for "pop-up" dispensing. In such a configuration, the leading end edge of the trailing wipe is loosened from the stack by the trailing end edge of the leading wipe as the leading wipe is removed by the user. The wipes can be interfolded to facilitate such dispensing by means known to those skilled in the art.

Yet alternatively, the wipes can be arranged in the dispenser as a continuous web of interconnected wipes which are folded in an accordion-like stacked configuration or a roll. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. The portion of the web of material between successive lines of frangibility provides each individual wipe. The lines of frangibility can be provided by means known to those skilled in the art such as perforations, indentations or cuts in the web of material. For example, the lines of frangibility or perforations can be provided in the web of material by passing the web of material between a die cutter roll and anvil roll. After the lines of frangibility have been incorporated into the web of material, the web can then be arranged in a stacked or rolled configuration for easy insertion into the dispenser.

Additionally, the container 10 can store any suitable number of individual wipes. For example, the container 10 can be configured to include at least about 5 wipes and desirably from about 8 to about 320 individual wipes, and more desirably from about 16 to about 80 wipes.

The container 10 and the interrelation of its components can be referred to in terms of dimensions of "height," "width," and "depth." These terms are not meant to be limiting in terms of orientation, but are merely helpful for discussing the relative dimensions of the exemplary container 10 and its components. FIG. 1 provides a three dimensional axes in which "height" is measured in the axis denoted as "H," "width" is measured in the axis denoted as "W," and depth is measured in the axis denoted as "D."

Figure 4:
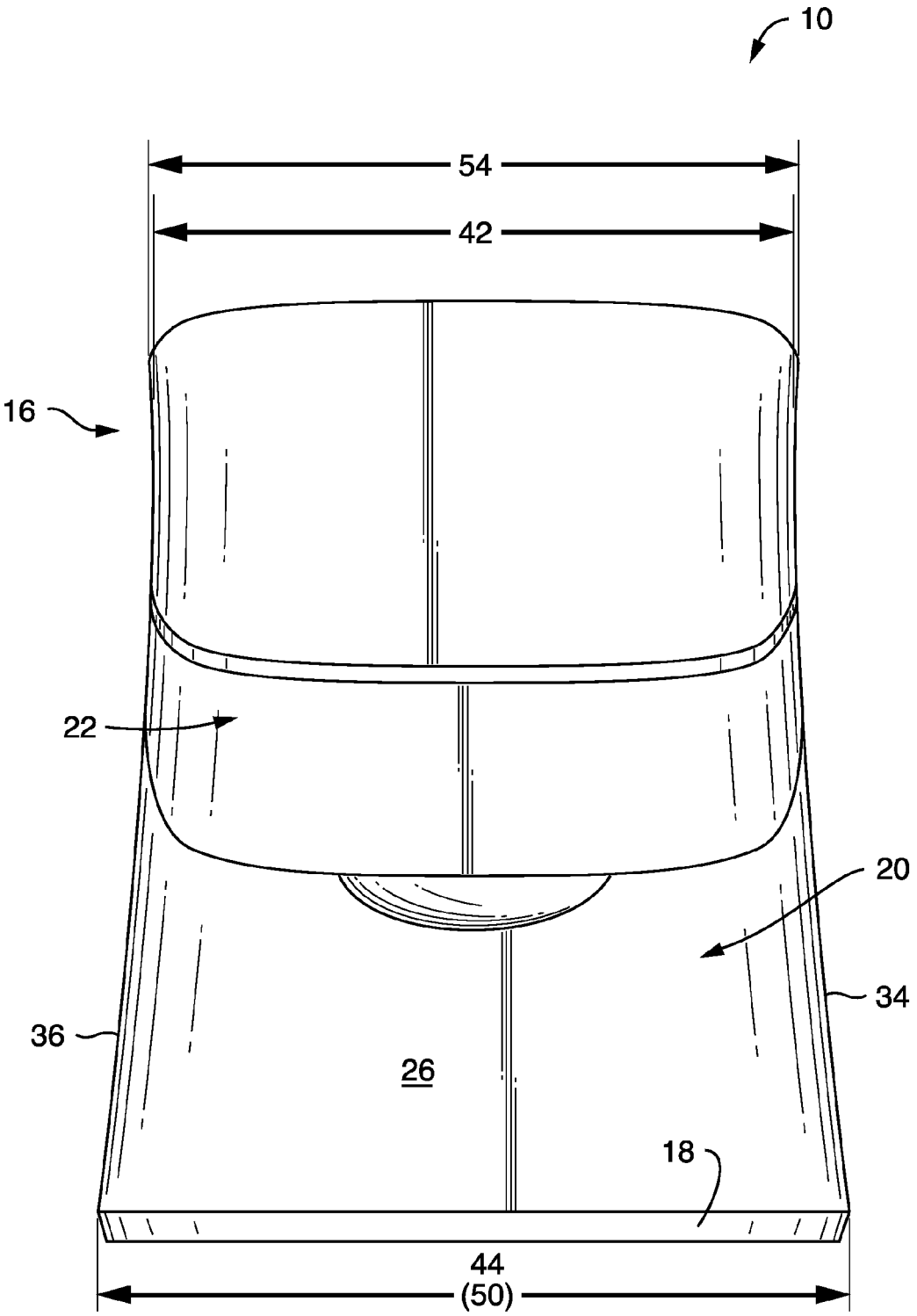
FIG. 4 illustrates a front elevational view of the wipes container of FIG. 1.
Figure 5:
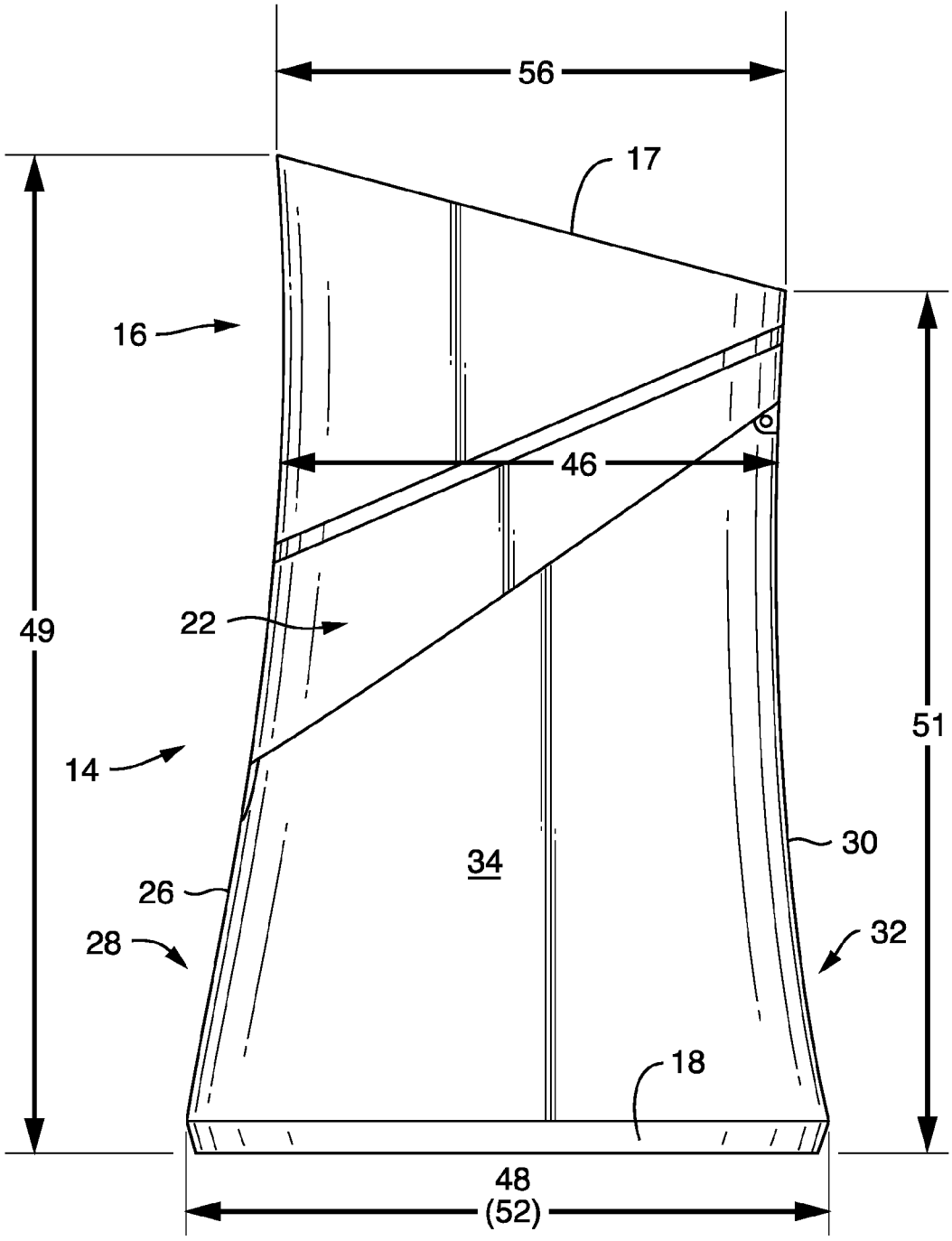
FIG. 5 illustrates a side elevational view of the wipes container of FIG. 1.
Figure 6:
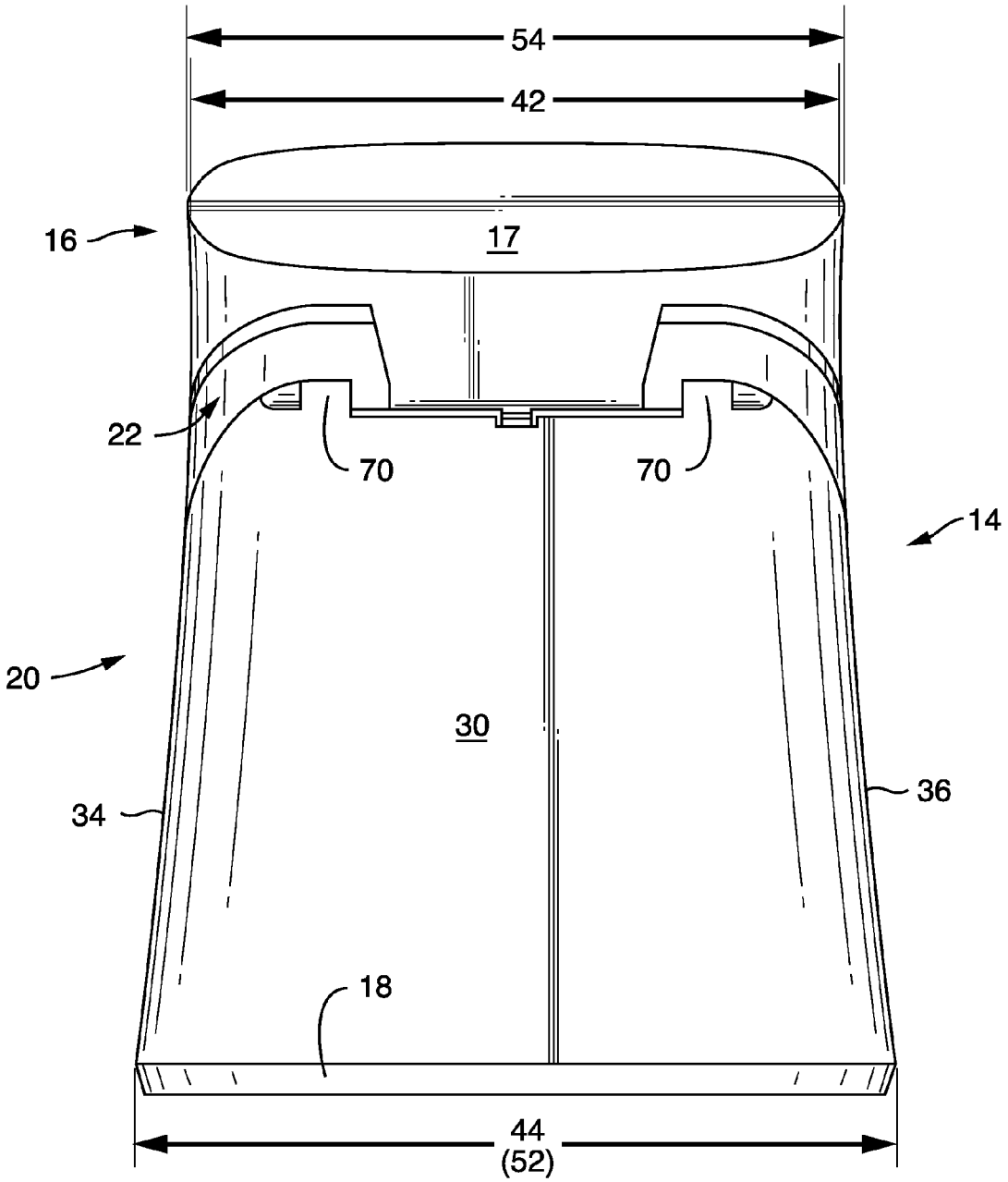
FIG. 6 illustrates a rear elevational view of the wipes container of FIG. 1.
Figure 7:
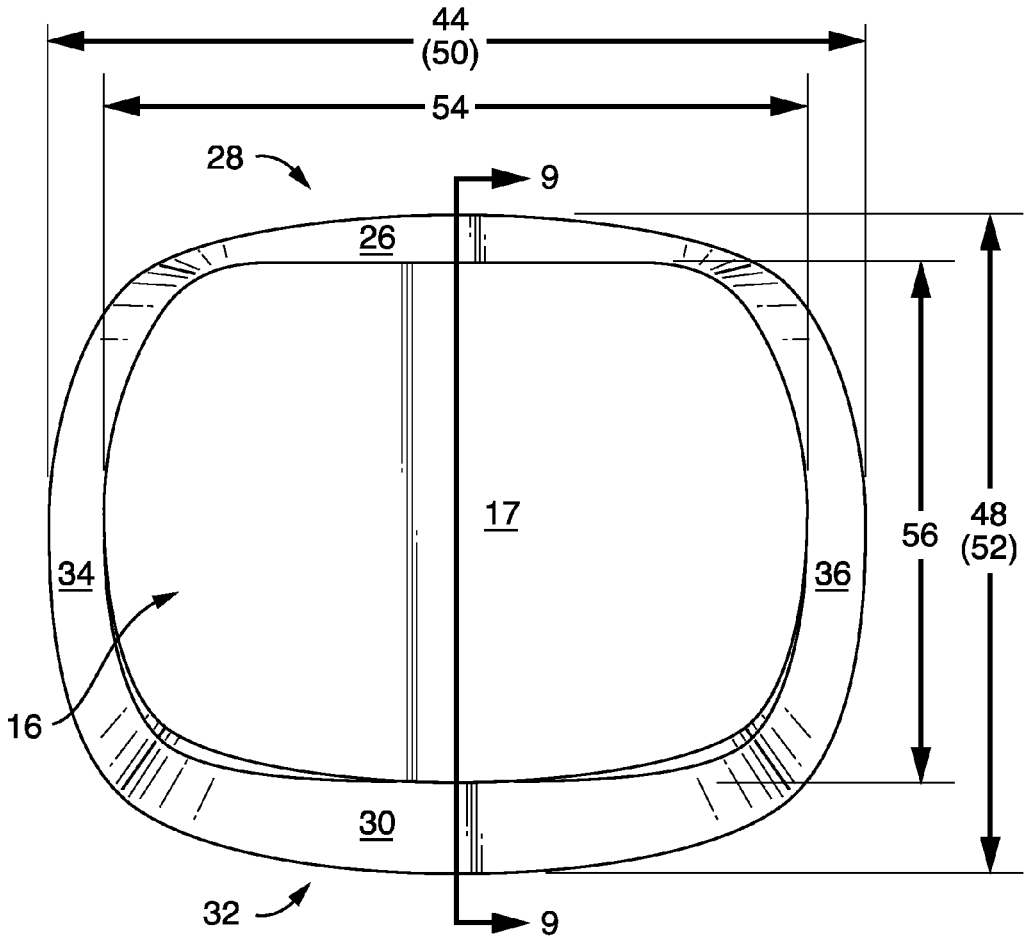
FIG. 7 illustrates a top plan view of the wipes container of FIG. 1.

The container 10 can include a minimum container width 42, shown in FIGS. 4 and 6, and a maximum container width 44, shown in FIGS. 4, 6, and 7. The container 10 can include a minimum container depth 46, shown in FIG. 5, and a maximum container depth 48, shown in FIGS. 5 and 7. The container 10 also has a maximum container height 49, measured as the greatest distance between the bottom wall 18 and the lid 16 of the container 10, as shown in FIG. 5. Because the top surface 17 of the lid 16 is angled towards the front portion 28 of the container 10, the maximum container height 49 is in the front portion 28 of the container 10 and is greater than the height 51 of the container 10 at a rear portion 32 of the container 10.

The bottom wall 18 can include a maximum bottom wall width 50, shown in FIGS. 4, 6, and 7, and a maximum bottom wall depth 52, shown in FIGS. 5 and 7. In the exemplary embodiment shown in FIGS. 1-12, the maximum bottom wall width 50 is equivalent to the maximum container width 44, and the maximum bottom wall depth 52 is equivalent to the maximum container depth 48. Additionally, the lid 16 can include a maximum lid width 54, shown in FIGS. 4, 6, and 7, and a maximum lid depth 56, shown in FIGS. 5 and 7.

Unlike some container configurations, the exemplary container 10 is structurally configured to provide certain dimensional height, width, and/or depth dimensional relationships between the container 10 and its components to provide certain benefits. For example, as illustrated in FIG. 5, the maximum bottom wall depth 52 is greater than the minimum container depth 46. Additionally, the maximum lid depth 56 is greater than the minimum container depth 46. Each of these relationships provides increased ability for a consumer to hold the container 10 and/or open the lid 16 of the container 10 to dispense or refill wipes. Also, the maximum lid depth 56 is less than the maximum bottom wall depth 52. The maximum bottom wall depth 52 also provides the maximum container depth 48. This helps to lower the center of gravity of the container 10, which improves the stability of the container 10 during use and/or if the container 10 is unintentionally contacted when resting on a surface.

As illustrated in FIGS. 4 and 6, the maximum bottom wall width 50 is greater than the minimum container width 42. The maximum lid width 54 is also greater than the minimum container width 42. Similar to the depth relationships noted above, these relationships each provide increased ability for a consumer to hold the container 10 and/or open the lid 16 of the container 10 to dispense or refill wipes. Furthermore, the maximum lid width 54 is less than the maximum bottom wall width 50 and the maximum bottom wall width 50 is equivalent to the maximum container width 44. These configurations provide the container 10 with a lower center of gravity to provide enhanced stability.

Furthermore, the maximum container height 49 occurs in the front portion 28 of the container 10, as opposed to the rear portion 32 of the container 10, due to the angled top surface 17 of the lid 16. This provides that the center of gravity may be closer to the front portion 28 of the container 10 than the rear portion 32 of the container 10, which may help prevent tipping of the container 10 towards the rear portion 32 of the container 10 should the container 10 be contacted in a front portion 28 of the container 10 when a consumer contacts the lid 16 to rotate the lid 16 to the open position.

Additionally, the wipes 12 are stacked in a vertical orientation with the maximum height of the container 49 being greater than the maximum container width 44 and the maximum container depth 48. This provides a smaller footprint for the container 10, which may be especially advantageous where space is limited on work surface, countertops, toilet tank lids, and other areas where such containers 10 may be kept, depending on the intended end use.

Turning now to FIG. 8, the container 10 as described above is placed on a surface 58. When the rear portion 32 of the container 10 is positioned against a wall 60 that is substantially perpendicular to the surface 58 the lid 16 of the container 10, the lid 16 can still open sufficiently to provide access to a leading edge 12*a* of the next successive wipe in the plurality of wipes 12. As shown in FIG. 8, even though the lid 16 is coupled to a rear portion 32 of the container 10 about a hinge axis 62, the lid 16 is still able to open sufficiently because the maximum lid depth 56 is less than a maximum container depth 48. Thus, a gap 64 is provided between the lid 16 and the wall 60 that allows the lid 16 to open sufficiently to provide access to the wipes 12 without having to move the container 10 away from the wall 60. Additionally, the low profile of the angled top surface 17 of the lid 16 in the rear portion 32 provides more clearance between the lid 16 and the wall 60 when the lid 16 rotates towards the open position.

The functionality of the how the lid 16 opens and closes will now be described with reference to FIGS. 9-12. In the exemplary embodiment of the container 10 described in FIGS. 1-12, the lid 16 is hingedly coupled to a rear portion 32 of the container 10. As shown in detail in FIG. 10, a rear segment 68 of the lid 16 is coupled to a hinge pin 66. As shown in FIG. 3, the hinge pin 66 is journaled on each of its ends in receiver portions 70 defined by the rear wall 30 of the container 10. Also shown in FIG. 3, the top wall 22 is also hingedly coupled to the hinge pin 66 and can rotate with respect to the midsection 20 about the hinge axis 62 defined by the hinge pin 66.

Figure 12:
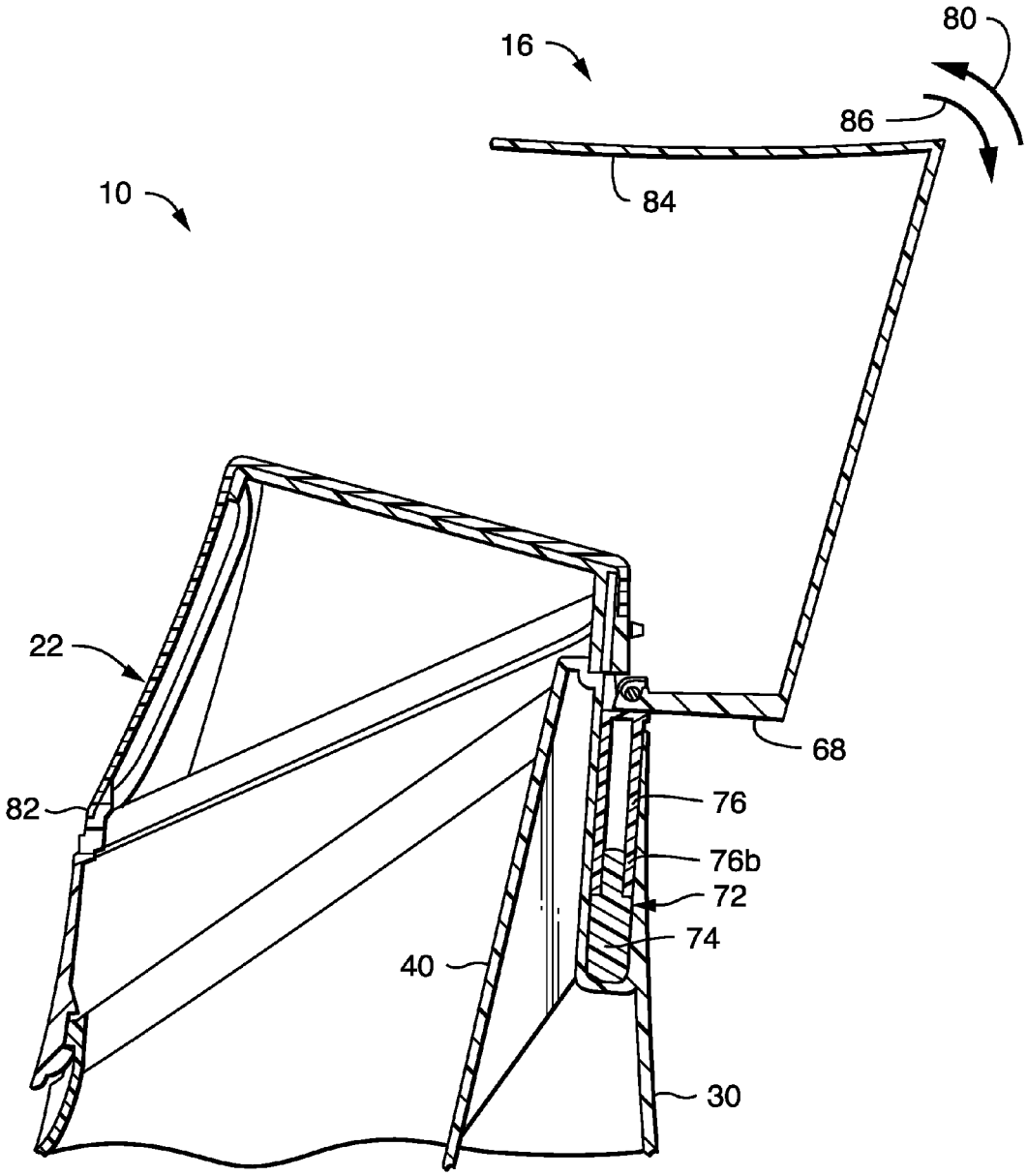
FIG. 12 illustrates a cross-sectional, detailed view similar to FIG. 9, but with the lid being in an open position.

Furthermore, the container 10 includes a slot 72 in the rear wall 30 of the midsection 20. The slot 72 is configured to receive an elastic element 74 and a plunger 76. The plunger 76 has a proximal end 76*a* and a distal end 76*b*. The distal end 76*b* of the plunger 76 engages the elastic element 74. The elastic element 74 can be compressed and loaded during installation of the plunger 76 in the slot 74, and can remain compressed and loaded when the lid 16 is in the closed position as shown in FIG. 9, as well as when the lid 16 is in the open position, as shown in FIG. 12. While the elastic element 74 is shown as a solid component capable of elastic deformation, a coil spring or other suitable elastic component can alternatively be used.

As shown in FIG. 10, a bottom portion 78 of the rear segment 68 of the lid 16 engages the proximal end 76*a* of the plunger 76. Preferably, the bottom portion 78 is rounded. When the elastic element 74 is loaded when the lid 16 is in the closed position, as illustrated in FIGS. 9 and 10, the plunger 76 exerts a rotational force on the lid 16 in rotational direction 80 due to the location of contact between bottom portion 78 and the proximal end 76*a* of the plunger 76 in relation to the hinge pin 66. A line 90 drawn perpendicular to the proximal end 76*a* of the plunger 76 and passing through the center of the hinge pin 66 establishes how the linear forces of the elastic element 74 and plunger 76 will be translated to a rotational movement of the bottom portion 78 of the lid 16. Because the contact between the proximal end 76*a* of the plunger 76 and the bottom portion 78 of the lid 16 is to the right of the intersection of line 90 and the proximal end 76*a* of the plunger 76 at point 92 (as shown in FIG. 10), the elastic element 74 applies a force to the lid 16 to urge the lid 16 to move in rotational direction 80 to keep the lid 16 in the closed position.

The force applied to urge the lid 16 to the closed position and remain in that position is particularly beneficial in the case where the wipes 12 stored within the container 10 are wet wipes and the lid 16 needs to provide a gasketing effect to retain moisture in the wipes 12. As shown in FIG. 3, the top wall 22 can include a raised rib 82 around a substantial portion of the perimeter of the top wall 22, which in the exemplary embodiment, is composed of TPE. Therefore, when the lid 16 is in the closed position, the raised rib 82 can sealingly engage an inner surface 84 of the lid 16, the sealing engagement being strengthened by the force the elastic element 74 applies to urge the lid 16 to the closed position. Advantageously, this urging force to keep the lid 16 in the closed position and to seal the lid 16 against the top wall 22 is completed without a traditional latching mechanism, such as the latch 88 used to close the top wall 22 to the front wall 26 of the midsection 20. Unlike a traditional latching mechanism, the elastic element 74 can automatically urge the lid 16 of the container 10 to the closed position to assist a consumer in closing the lid 16.

When a consumer desires to open the lid 16, the consumer applies a force to the lid 16 in a rotational direction 86 sufficient to overcome the force applied to the lid 16 by the elastic element 74 in rotational direction 80, as illustrated in FIG. 11. When the consumer rotates the lid 16 in rotational direction 86 to move the lid 16 to the open position, the bottom portion 78 of the rear segment 68 of the lid acts as a cam and cams against the proximal end 76*a* of the plunger 76. In doing so, the plunger 76 slides in the slot 72 and further compresses, or loads, the elastic element 74. FIG. 11 shows the contact between the bottom portion 78 and the proximal end 76*a* of the plunger 76 being at point 92. However, once the bottom portion 78 rotates past the intersection of line 90 and the proximal end 76*a* of the plunger 76 at point 92 (to the left of point 92 as viewed from FIG. 11), the force the elastic element 74 applies to the plunger 76 translates to forcing the bottom portion 78 of the lid 16 in rotational direction 86, which will urge the lid 16 to an open position, as illustrated in FIG. 12. During this rotation, the bottom portion 78 eventually allows the plunger 76 to move in a vertically upwards direction, allowing the elastic element 74 to decompress, or unload, at least partially.

When a consumer desires to move the lid 16 from an open position to a closed position, the rotational forces and camming action of the bottom portion 78 of the rear segment 68 of the lid 16 against the proximal end 76*a* of the plunger functions in a similar, but opposite, manner. Initially, the consumer applies a force to the lid 16 in rotational direction 80 sufficient to overcome the force applied to the bottom portion 78 of the lid 16 in rotational direction 86. However, as the consumer rotates the lid 16 in direction 80 and the point of contact between the bottom portion 78 of the lid 16 and the proximal end 76*a* of the plunger 76 is to the right of point 92 (as viewed from FIG. 11), the elastic element 74 provides a force to the plunger 76 which urges the lid 16 to rotate in rotational direction 80 to a closed position, as illustrated in FIGS. 9 and 10.

As shown in FIGS. 9-12, the lid 16 of the exemplary embodiment can rotate approximately 90° between the closed position and the open position, with the angle of rotation α being defined by the intersection of a line 94 parallel to the rear segment 68 of the lid 16 and a line 96 parallel to the proximal end 76*a* of the plunger 76, as illustrated in FIGS. 10 and 11. For reference purposes, when the lid 16 in the closed position the angle of rotation α is equal to about 90° and when the lid 16 is in the open position the angle of rotation α is equal to about 0°.

The configuration of the lid 16, elastic element 74, and plunger 76 are such that the lid 16 is urged to the closed position when the lid 16 is in a first range of positions between the open position and the closed position and the lid 16 of the container 10 is urged to the open position when the lid 16 is in a second range of positions between the open position and the closed position. In the embodiment shown in FIGS. 1-12, the location of contact between the bottom portion 78 of the lid 16 and the proximal end 76*a* of the plunger 76 relative to point 92 on the proximal end 76*a* of the plunger 76 defines whether the elastic element 74 will urge the lid 16 in a rotational direction 80 towards a closed position, or in rotational direction 86 towards an open position. Thus, point 92 serves as a transition point for the urging force that is translated to the lid 16 by the elastic element 74. In the non-limiting example described herein, the transition point 92 occurs when the angle of rotation α is equal to about 50°.

This configuration provides the benefit that once the consumer rotates the lid 16 to an angle of rotation α of greater than about 50°, the lid 16 is urged to the closed position even if the consumer stops applying any force to the lid 16. Thus, in such a circumstance when the lid 16 is in a position having an angle of rotation greater than about 50°, the lid 16 essentially closes itself and forms a reliable moisture seal for the container 10. This will help to prevent the wet wipes 12 from drying out, as is the case with a traditional latch if the latch is not completely engaged. Additionally, this configuration provides the benefit that once the user rotates the lid 16 to an angle of rotation in the rotation α of less than about 50°, the lid 16 essentially opens itself and remains open. This provides the benefit of allowing the consumer to not have to hold the lid 16 open while dispensing a wipe from the plurality of wipes 12 or performing other activities.

Depending on the shape and location of the bottom portion 78 of the rear segment 68 of the lid 16, the point 92 from where the elastic element 74 applies a force to the plunger 76 that urges the lid 16 to a closed position and applies a force to the plunger 76 that urges the lid 16 to an open position can vary. It is not intended that this transition between urging the lid 16 closed and urging the lid 16 open be limited to an angle of rotation α of about 50°, as shown in embodiment described herein, or even to a transition point 92 that occurs based on rotational location. Rather, the configuration in the embodiment described herein and illustrated in FIGS. 1-12 is merely a preferable, non-limiting configuration.

Thus, the container 10 is configured to urge the lid 16 to the closed position and can also be configured to urge the lid 16 to the open position, depending on the particular position of the lid 16. As used herein, the term "urging" or "urged" with respect to the lid 16 of the container 10 is meant to encompass any type of active force, whether direct or indirect, that is provided by the container 10 to at least attempt to cause the lid 16 to change position, independent of the force of gravity and/or any force applied to the container 10 by a consumer. The force provided by the container 10 to cause the lid 16 to change position towards the closed and/or open position can be less than the force of gravity, equal to the force of gravity, or greater than the force of gravity. The container 10 can be configured, such as in the preferred embodiment described herein, where the force of gravity is additive to the force that the container 10 provides to urge the lid 16 to the closed position. The container 10 can also be configured such that the force of gravity could also be additive to the force that the container 10 provides to urge the lid to the open position.

As noted above, the structural configuration of the container 10 provides the container 10 with increased stability. This property is beneficial in that the container is less likely to tip over in the circumstance that a consumer loses grip on the container or the container 10 is inadvertently contacted when it is standing on a surface 58, especially where the container 10 discussed above is configured to store wipes 12 in a vertical orientation. To improve the stability of the container 10, the bottom wall 18 can include TPE or another rubber-like material, however, the structural configuration alone can provide benefits in stability over prior art containers configured to store wipes 12 in a vertical orientation.

To demonstrate and quantify the increased stability of an exemplary embodiment, a Tip Test was conducted for the container 10 as well as for other containers configured to store wipes in a vertical orientation. The Tip Test was configured based on ASTM D6179-07, which is hereby incorporated by reference as if fully set forth herein. Specifically, Test Method F in ASTM D6179-07 discloses a Tip Test that determines whether a filled container will tip over when tilted to a predetermined angle. The Tip Test provides useful indicia quantifying the stability of the container while storing its intended contents.

Figure 13:
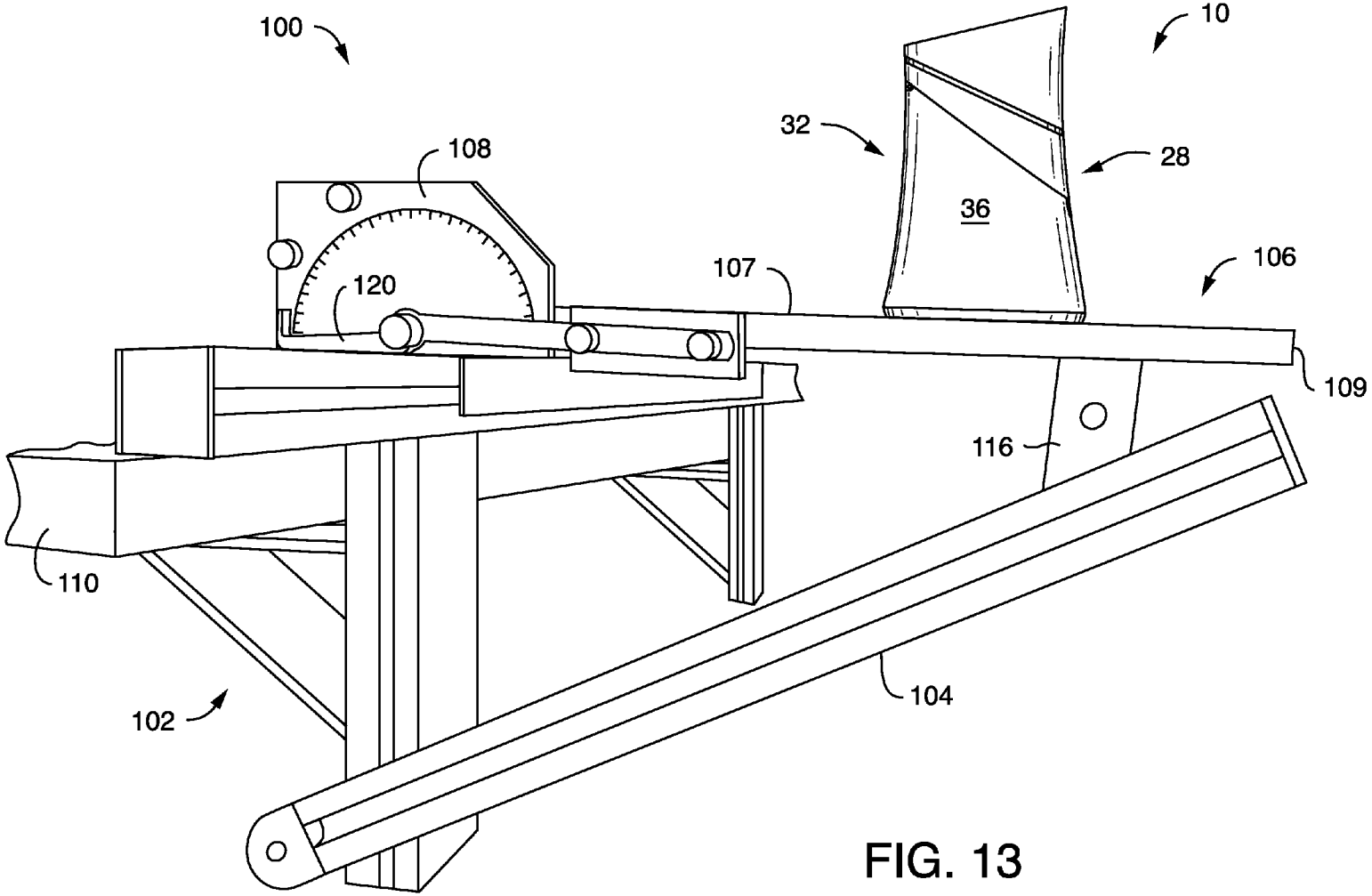
FIG. 13 illustrates a side perspective view of an exemplary Tip Test apparatus to perform a Tip Test on the wipes container of FIG. 1, with the wipes container being oriented in a forward facing direction.

The Tip Test apparatus 100 used for performing the Tip Test described herein is illustrated in FIGS. 13-16. The Tip Test apparatus 100 includes a support structure 102, a pivot arm 104, a tiltable member 106, and a protractor 108. As shown in FIG. 13, a container 10 is positioned on a top surface 107 of the tiltable member 106 when performing the Tip Test. The support structure 102 is coupled to a structure 110, such as a lab bench, such that the support structure 102 remains fixed.

A thin sheet of a rubber-like, anti-slip material (not shown), such as TPE, can be provided on the top surface 107 where the container will be placed when the container does not have such a rubber-like, anti-slip material on its bottom wall. Such material will prevent the container from merely slipping off of the top surface 107 during the Tip Test, as will be described further below. Sample rubber-like materials for the thin sheet can be obtained from a variety of manufacturers, such as GLS Corporation of McHenry, Ill. known as resin OM 1060. Another such material for the flexible, rubber-like sheet could be that manufactured by the GLS Corporation of McHenry, Ill. and known as resin #G2701. The G2701 material is another one of the resins in the product family of TPEs. G2701 is a styrenic-based material and is in the family of Styrenic block copolymer compounds. Another similar material is known as G2755 and also sold by GLS Corporation.

Figure 14:
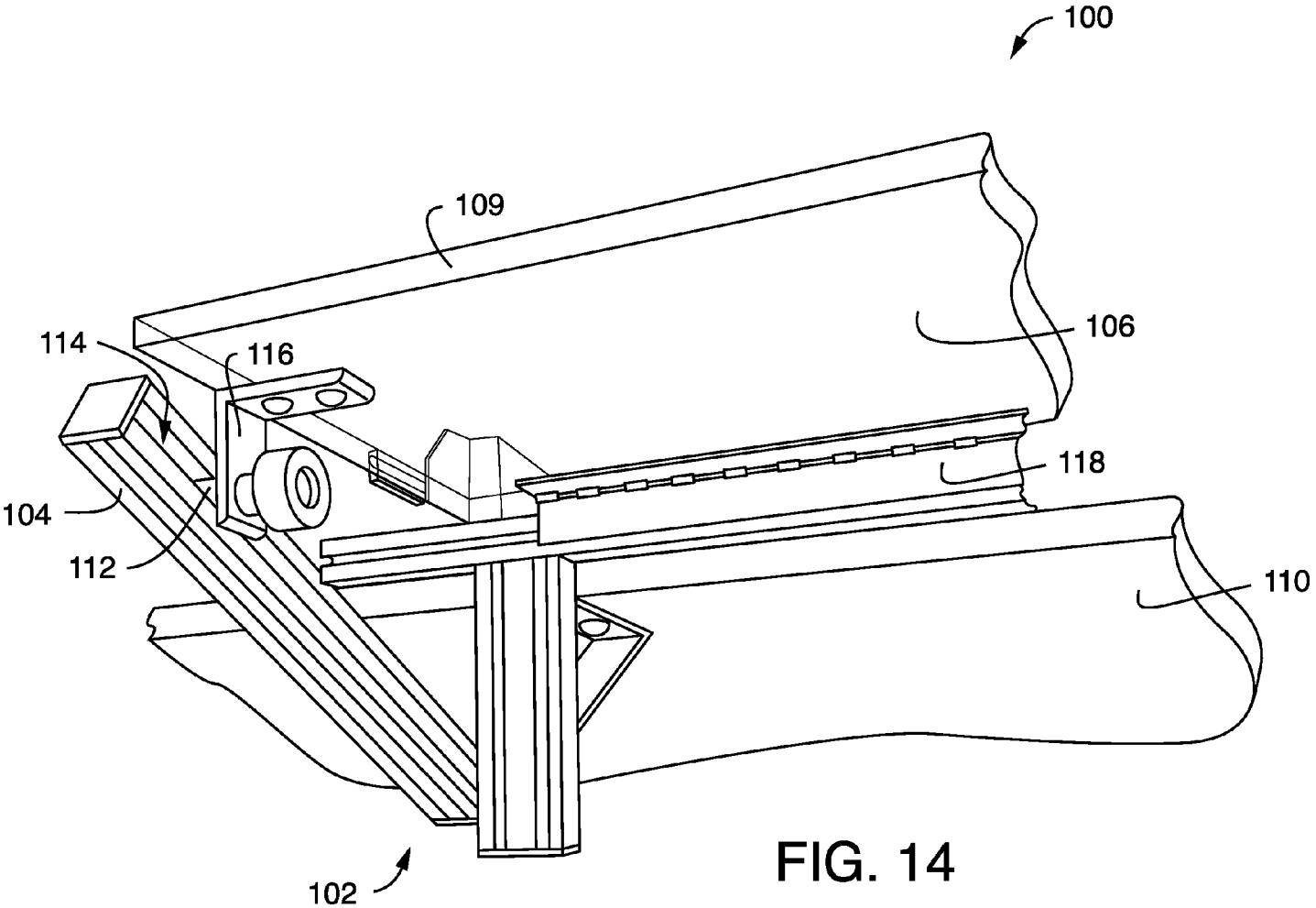
FIG. 14 illustrates a bottom perspective view of some of the exemplary equipment of the exemplary Tip Test apparatus of FIG. 13.
Figure 15:
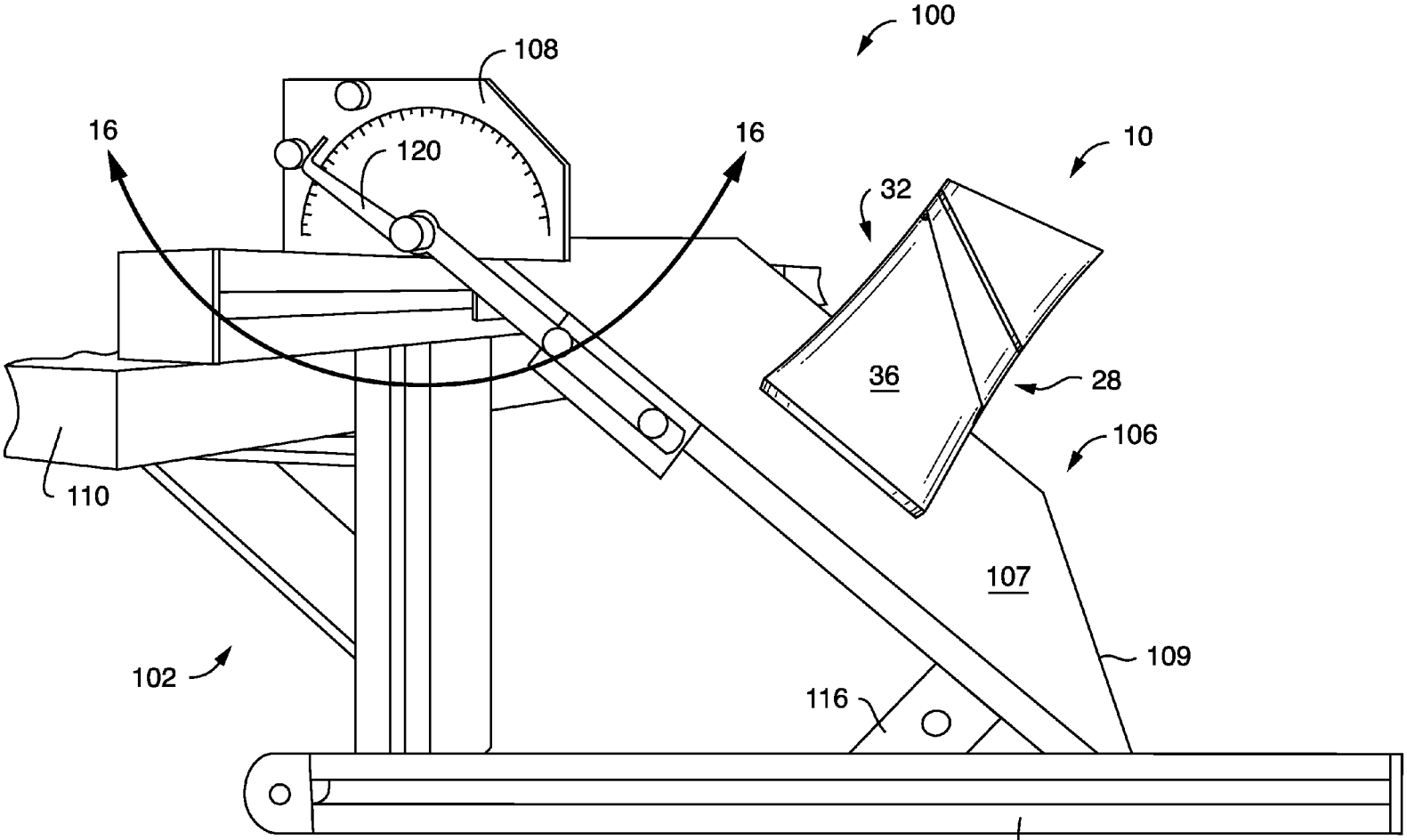
FIG. 15 illustrates a side perspective view of the tiltable member of the exemplary Tip Test apparatus being tilted during an exemplary Tip Test.
Figure 16:
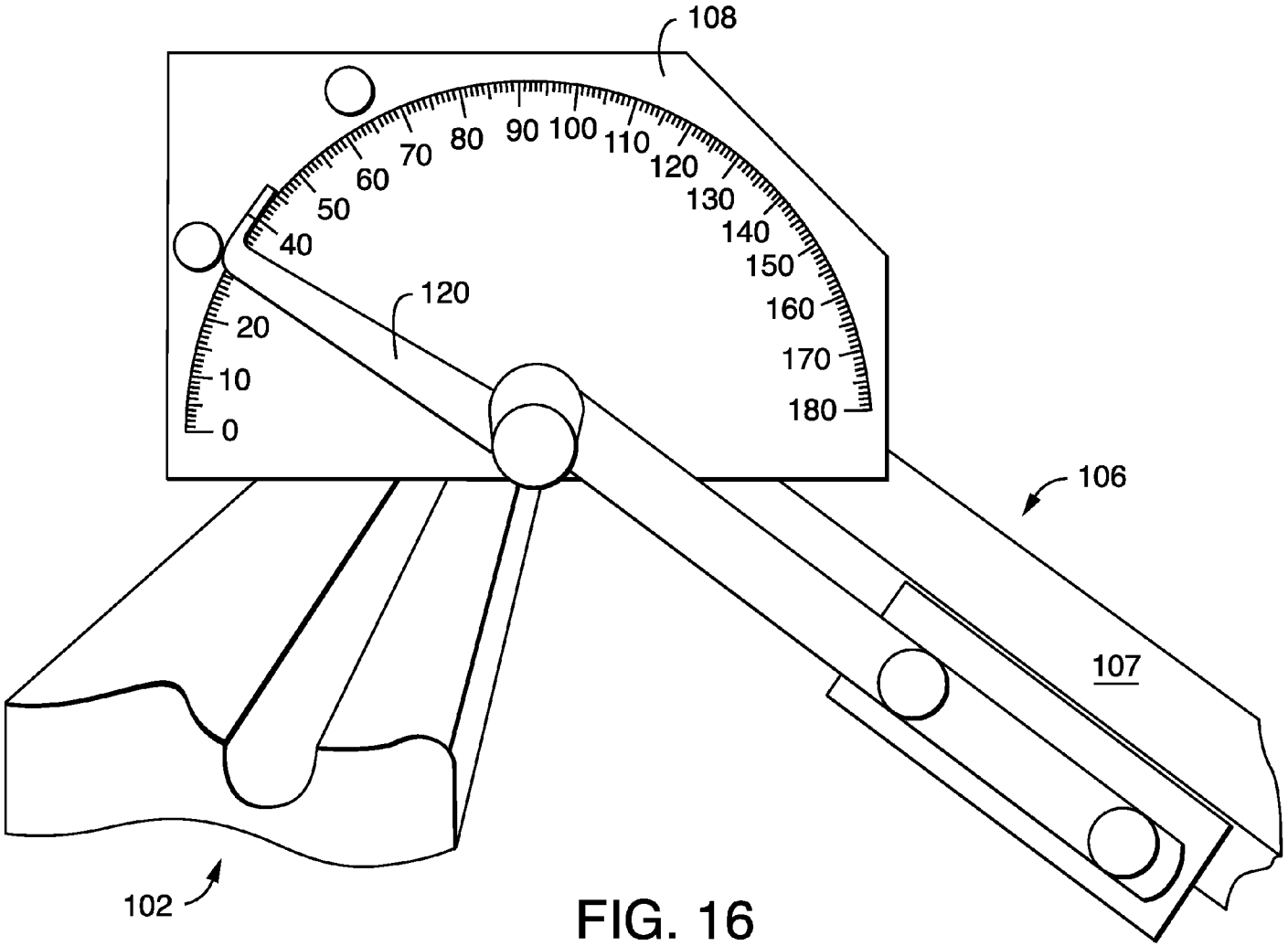
FIG. 16 illustrates a detailed view taken along line 16-16 in FIG. 15.

As illustrated in FIG. 14, the Tip Test apparatus 100 can include a positioning bolt 112 that is received in a slot 114 in the pivot arm 104. The positioning bolt 112 couples the tiltable member 106 to the pivot arm 104 with an L-shaped bracket 116. As also shown in FIG. 14, the tiltable member 106 is rotatably coupled to the support structure 102 with a hinge 118. Thus, when it is desired to tilt the tiltable member 106 in performing the Tip Test, which will be described in further detail below, the positioning bolt 112 can be loosened such that the tiltable member 106 can be tilted with respect to the support structure 102, as shown in FIG. 15. The protractor 108 is coupled to the support structure 102 and has a measurement arm 120 that allows a tester to determine the angle in which the tiltable member 106 is tilted at with respect to the support structure 102, as shown in FIG. 16.

The methodology for the Tip Test discussed herein involved testing containers for a Stability Value in each of three directional orientations: a forward facing direction, a rear facing direction, and a side facing direction. These three orientations will be described for container 10 as shown on the Tip Test apparatus 100 in FIGS. 13 and 15, however, the directional orientations apply to any type of container tested in a Tip Test. The forward facing direction is illustrated by container 10 in FIGS. 13 and 15 and for the purposes of the Tip Test described herein is the orientation where the front portion 28 of the container 10 is facing the front edge 109 of the tiltable member 106. The rear facing direction of a container for the purposes of the Tip Test described herein is the orientation of a container 10 where the rear portion 32 of the container 10 is facing the front edge 109 of the tiltable member 106. Thus, container 10 as illustrated in FIG. 13 could be placed in a rear facing direction by rotating the container 10 180° on the surface 107 of the tiltable member 106. The side facing direction of a container for the purposes of the Tip Test described herein is the orientation of a container where one side wall 34 of the container 10 is facing the front edge 109 of the tiltable member 106. Thus, container 10 as illustrated in FIG. 13 could be placed in a side facing direction by rotating the container 90° in either direction on the surface 107 of the tiltable member 106.

For generally cylindrically shaped containers, the directional orientations of forward facing direction, rear facing direction, and side facing direction still apply, despite the fact that these containers have a midsection that is configured as a unitary structure without segments, and thus, less likely to have a common "front," "back," and "side walls" that make up a midsection. However, a generally cylindrically shaped container will be considered to be in a forward facing direction for the purposes of the Tip Test described herein when the opening mechanism on the lid is facing the front edge 109 of the tiltable member 106. If there is no distinguishable opening mechanism, then the generally cylindrically shaped container will be considered to be in the forward facing direction for the purposes of the Tip Test described herein when the primary brand graphics are facing the front edge 109 of the tiltable member 106. The rear facing and side facing directions are configured just as noted above with respect to container 10, with the rear facing direction being when the container is rotated 180° on the surface 107 of the tiltable member 106 from the forward facing direction, and the side facing direction being when the container is rotated 90° on the surface 107 of the tiltable member 106 from the forward facing direction.

The methodology for obtaining a Stability Value for a container will now be described. First, the angle of the tiltable member 106 is adjusted with the positioning bolt 112 as described above to position the tiltable member 106 such that the measurement arm 120 on the protractor 108 shows that the surface 107 of the tiltable member 6 is at 0°. Then, the bottom wall 18 of the container 10 is placed on the surface 107 of the tiltable member 106 in the desired directional orientation for performing the Tip Test. Preferably, the container is placed in approximately the center portion of the surface 107. Once the container is in place, the tester can manipulate positioning bolt 112 and tilt the tiltable member 106 with respect to the support structure 102 in 1° increments. At each 1° angular increment, the tester should stop the tiltable member 106 by locking positioning bolt 112 for a period of time equal to at least one second. If the container does not tip over at that angular increment, the tester should then move to the next angular increment. This process should be repeated until the container tips over such that the bottom wall of the container no longer rests on the top surface 107 of the tiltable member 106.

The angle at which the container first tips over during this process is referred to as the Tip Angle Value. The tester should repeat this Tip Test methodology for each of the desired directional orientations of the container three times to obtain three Tip Angle Values. Once at least three Tip Angle Values are obtained for the desired directional orientation, the tester can average the Tip Angle Values for that directional orientation, rounding to the nearest whole number, to calculate the Stability Value associated with that directional orientation.

EXAMPLE

In the Tip Test conducted herein, an exemplary container 10 as described above was compared to three other containers that are configured to store wipes in a vertical orientation. The three comparison containers were a HUGGIES® Natural Care Wipes container, manufactured by Kimberly-Clark Corporation (referred to as "HUGGIES® Container"), a Lysol® Dual Action Disinfecting Wipes container, distributed by Reckitt Benckiser (referred to as "Lysol® Container"), and a germ-X® Antibacterial Soft Wipes container, distributed by Vi-Jon (referred to as "germ-X® Container").

The exemplary container 10 described above as well as the HUGGIES® Container container each had a rubber-like, anti-slip material on their respective bottom walls. However, the Lysol® Container and the germ-X® Container did not have a rubber-like, anti-slip material on their respective bottom walls, and thus, a thin sheet of TPE (not shown) was removably fastened to the surface 107 of the tiltable member 106 where these containers were positioned for the Tip Test, for the reasons noted above. Each of the tested containers was tested with the lid in the closed position and with the intended contents of wet wipes.

The container 10 and the three comparison containers underwent a Tip Test in each of the three directional orientations described above, with "F" meaning forward facing direction, "R" meaning rear facing direction, and "S" meaning side facing direction, to obtain the following data set for Tip Angle Values. As shown below in Table 1, the Stability Values were calculated for each of the three directional orientations for each of the tested containers based on the recorded Tip Angle Values for each container.

TABLE 1

Comparison of Stability Values for Various Vertically Oriented Wipes Containers

| | Exemplary Container | | | HUGGIES ® Container | | | Lysol ® Container | | | germ-X ® Container | | |
|---|---|---|---|---|---|---|---|---|---|---|---|---|
| Sample | F | R | S | F | R | S | F | R | S | F | R | S |
| 1 | 31 | 32 | 38 | 16 | 19 | 30 | 17 | 17 | 18 | 20 | 23 | 26 |
| 2 | 31 | 32 | 38 | 16 | 18 | 30 | 16 | 18 | 18 | 21 | 23 | 25 |

TABLE 1-continued

Comparison of Stability Values for Various Vertically Oriented Wipes Containers

| | Exemplary Container | | | HUGGIES ® Container | | | Lysol ® Container | | | germ-X ® Container | | |
|---|---|---|---|---|---|---|---|---|---|---|---|---|
| Sample | F | R | S | F | R | S | F | R | S | F | R | S |
| 3 | 30 | 32 | 37 | 16 | 17 | 30 | 17 | 17 | 18 | 22 | 25 | 25 |
| Stability Value | 31 | 32 | 38 | 16 | 18 | 30 | 17 | 17 | 18 | 21 | 24 | 25 |

As illustrated in Table 1 above, the exemplary container 10 has improved stability values in comparison to other vertically oriented wipes containers. For example, the container 10 has a Stability Value of 31 when the container is oriented in the forward facing direction during the Tip Test. Also, the container 10 has a Stability Value of 32 when the container 10 is oriented in the rear facing direction during the Tip Test. Lastly, the container 10 has a Stability Value of 38 when the container 10 is oriented in the side facing direction during the Tip Test. The structural configuration of the container 10 provides such improved Stability Values over other vertically oriented wipes containers.

Accordingly, the different aspects and features of the present disclosure can provide containers for wipes which, when compared to conventional containers for wipes, provide improved grip and handling of the container, improved ease of dispensing of wipes, and improved closing of the lid. The different aspects and features of the present disclosure can also provide more reliable closing and sealing of the lid, providing improved moisture retention in the wipes in the case where the wipes stored in the container are wet wipes.

While a container, useful for purposes of this present disclosure, has been specifically illustrated in the figures, those skilled in the art will appreciate that many different container designs are possible without departing from the scope of the invention and other modifications and variations to the appended claims may be practiced by those of ordinary skill in the art, without departing from the spirit and scope as set forth in the appended claims. Thus, it will be appreciated that the foregoing description, given for purposes of illustration, is not to be construed as limiting the scope of the present disclosure, which is defined by the following claims and all equivalents thereto.

We claim:

1. A container for storing a plurality of wipes that can be dispensed by a consumer, the container comprising:

a container body including a bottom wall, a midsection, and a top wall, the container body defining an interior cavity configured for storing the plurality of wipes;

a dispensing aperture in the container body; and a lid configured to move between an open position and a closed position, the open position providing access to the dispensing aperture and the closed position hindering access to the dispensing aperture;

wherein the lid is urged to the closed position when the lid is in a first range of positions between the open position and the closed position, wherein the lid is urged to the open position when the lid is in a second range of positions between the open position and the closed position, the container further comprising an elastic element, wherein the elastic element urges the lid to the closed position when the lid is in the first range of positions between the open position and the closed position and the elastic element urges the lid to the open position when the lid is in the second range of positions between the open position and the closed position, the container further comprising a plunger including a proximal end and a distal end, the distal end of the plunger engages the elastic element, wherein a portion of the lid cams against the proximal end of the plunger to load and unload the elastic element as the lid moves between the open position and the closed position.

2. The container of claim 1, wherein the lid rotates about a hinge through an angle of rotation between the open position and the closed position.

3. The container of claim 2, wherein the angle of rotation is about 90°.

4. The container of claim 2, wherein the angle of rotation of the lid is equal to about 90° when the lid is in the closed position and equal to about 0° when the lid is in the open position, and the first range of positions of the lid between the open position and the closed position includes where the angle of rotation of the lid is greater than about 50°.

5. The container of claim 2, wherein the angle of rotation is equal to about 90° when the lid is in the closed position and equal to about 0° when the lid is in the open position, and the lid is urged to the open position when the lid is in a second range of positions between the open position and the closed position, and wherein the second range of positions between the open position and the closed position includes where the angle of rotation of the lid is less than about 50°.

6. The container of claim 1, wherein when the lid is in the closed position, an inner surface of the lid forms a continuous seal with the top wall around a perimeter of the top wall.

7. The container of claim 1, wherein the midsection includes a front wall, a rear wall, a first side wall, and a second side wall, the front wall being opposite the rear wall, the first side wall being opposite the second side wall, the dispensing aperture in the container body being positioned adjacent the front wall.

8. The container of claim 7, wherein the top wall includes a latch that latches with the front wall, the top wall rotating about the midsection at a hinge, the top wall including the dispensing aperture.

9. The container of claim 1, wherein the interior cavity is configured for storing the plurality of wipes in a stacked fashion and in a vertical orientation.

10. The container of claim 1, further comprising the plurality of wipes.

11. A container for storing a plurality of wipes that can be dispensed by a consumer, the container comprising:

a container body including a bottom wall, a midsection, and a top wall, the container body defining an interior cavity configured for storing the plurality of wipes;

a dispensing aperture in the container body;

a lid configured to move between an open position and a closed position, the open position providing access to the dispensing aperture and the closed position hindering access to the dispensing aperture; and an elastic element, wherein the elastic element urges the lid to the closed position, the container further comprising a plunger including a proximal end and a distal end, the distal end of the plunger engages the elastic element, wherein a portion of the lid cams against the proximal end of the plunger to load and unload the elastic element as the lid moves between the open position and the closed position.

12. The container of claim 11, wherein the elastic element urges the lid to the open position.

13. The container of claim 11, wherein the lid rotates about a hinge through an angle of rotation between the open position and the closed position.

14. The container of claim 13, wherein the angle of rotation is about 90°.

15. The container of claim 13, wherein the angle of rotation is equal to about 90° when the lid is in the closed position, and the lid is urged to the closed position when the lid is in a position having an angle of rotation greater than about 50°.

16. The container of claim 13, wherein the angle of rotation is equal to 0° when the lid is in the open position, and the lid is urged to the open position when the lid is in a position having an angle of rotation less than about 50°.

17. The container of claim 11, wherein when the lid is in the closed position, an inner surface of the lid forms a continuous seal with the top wall around a perimeter of the top wall.

18. The container of claim 11, wherein the midsection includes a front wall, a rear wall, a first side wall, and a second side wall, the front wall being opposite the rear wall, the first side wall being opposite the second side wall, the dispensing aperture in the container body being positioned adjacent the front wall.

19. The container of claim 18, wherein the top wall includes a latch that latches with the front wall, the top wall rotating about the midsection at a hinge, the top wall including the dispensing aperture.

20. The container of claim 11, wherein the interior cavity is configured for storing the plurality of wipes in a stacked fashion and in a vertical orientation.

21. The container of claim 11, further comprising the plurality of wipes.

22. A container for storing a plurality of wipes that can be dispensed by a consumer, the container comprising:

a container body including a bottom wall, a midsection, and a top wall hingedly connected to the midsection, the container body defining an interior cavity configured for storing the plurality of wipes;

a dispensing aperture in the container body; and a lid configured to rotate between an open position and a closed position, the open position providing access to the dispensing aperture and the closed position hindering access to the dispensing aperture;

wherein the top wall includes a raised rib around a substantial portion of a perimeter of the top wall, the raised rib sealingly engaging an inner surface of the lid when the lid is in the closed position, the container further comprising an elastic element, wherein the elastic element urges the lid to the closed position when the lid is in a first range of positions between the open position and the closed position and urges the lid to the open position when the lid is in a second range of positions between the open position and the closed position, the container further comprising a plunger including a proximal end and a distal end, the distal end of the plunger engages the elastic element, wherein a portion of the lid cams against the proximal end of the plunger to load and unload the elastic element as the lid moves between the open position and the closed position.

23. The container of claim 22, wherein the container is configured to urge the lid to the closed position.

24. The container of claim 22, wherein the container is configured to urge the lid to the open position.

25. The container of claim 22, wherein the midsection includes a front wall, a rear wall, a first side wall, and a second side wall, the front wall being opposite the rear wall, the first side wall being opposite the second side wall, and wherein the top wall includes a latch that latches with the front wall, the top wall rotating about the midsection at a hinge, the top wall including the dispensing aperture.

26. The container of claim 22, further comprising the plurality of wipes.

* * * * *